US009427995B2

(12) United States Patent
Shinohara

(10) Patent No.: US 9,427,995 B2
(45) Date of Patent: Aug. 30, 2016

(54) IMAGE RECORDING DEVICE

(71) Applicant: RISO KAGAKU CORPORATION, Minato-ku, Tokyo (JP)

(72) Inventor: Akio Shinohara, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/799,334

(22) Filed: Jul. 14, 2015

(65) Prior Publication Data

US 2016/0031247 A1 Feb. 4, 2016

(30) Foreign Application Priority Data

Jul. 30, 2014 (JP) ..... 2014-155462

(51) Int. Cl.
*B41J 29/38* (2006.01)

(52) U.S. Cl.
CPC ..... *B41J 29/38* (2013.01)

(58) Field of Classification Search
CPC ..... B41J 2002/16573; B41J 29/38
USPC ..... 347/19, 22, 23, 29, 30, 33, 34
See application file for complete search history.

(56) References Cited

U.S. PATENT DOCUMENTS 6,293,646 B1 * 9/2001 Beachnau Hood .. B41J 2/16526 347/23
2001/0015818 A1 * 8/2001 Kawanabe ..... B41J 2/165 358/1.15
2004/0136025 A1 * 7/2004 Moriyama ..... H04N 1/00002 358/1.14
2006/0268318 A1 * 11/2006 Lofthus ..... G06F 3/1208 358/1.15
2012/0189330 A1 * 7/2012 Kunimatsu ..... G03G 15/657 399/44
2013/0257941 A1 * 10/2013 Murata ..... B41J 2/16535 347/9

FOREIGN PATENT DOCUMENTS

JP 2008068438 A 3/2008

* cited by examiner

*Primary Examiner* — Stephen Meier
*Assistant Examiner* — Alexander D Shenderov
(74) *Attorney, Agent, or Firm* — Holtz, Holtz & Volek PC

(57) ABSTRACT

An image recording device includes a maintenance mechanism that conducts maintenance of recording head and a maintenance mechanism control unit that makes the maintenance mechanism conduct the maintenance at termination or start of one of process-target jobs for which cumulative number of sheets of the media that received printing processes by the recording head after immediately previous maintenance will reach lower limit of the cumulative number of sheets, which represents earliest start timing of the maintenance, and will not reach an upper limit of the cumulative number of sheets, which represents latest start timing of the maintenance, during printing process, and makes the maintenance mechanism conduct the maintenance before start of printing of a process-target job when priority on image quality, which requires high quality printing, is set in the process-target job and the cumulative number of sheets reaches the lower limit during a printing process of the process-target job.

7 Claims, 19 Drawing Sheets

T1

| JOB | IMAGE QUALITY PRIORITY FLAG | START FLAG |
|---|---|---|
| 1 | 0 | 0 |
| 2 | 1 | 1 |
| 3 | 1 | 0 |

F I G. 5

(A)

T1

| JOB | IMAGE QUALITY PRIORITY FLAG | START FLAG |
|---|---|---|
| 1 | 0 | 0 |
| 2 | 0 | 1 |
| 3 | 0 | 0 |

(B)

T1

| JOB | IMAGE QUALITY PRIORITY FLAG | START FLAG |
|---|---|---|
| 1 | 1 | 1 |
| 2 | 1 | 0 |
| 3 | 1 | 0 |

(C)

T1

| JOB | IMAGE QUALITY PRIORITY FLAG | START FLAG |
|---|---|---|
| 1 | 0 | 0 |
| 2 | 1 | 1 |
| 3 | 0 | 0 |

(D)

T1

| JOB | IMAGE QUALITY PRIORITY FLAG | START FLAG |
|---|---|---|
| 1 | 0 | 0 |
| 2 | 0 | 1 |
| 3 | 1 | 0 |

FIG. 10

IMAGE RECORDING DEVICE

CROSS-REFERENCE TO RELATED APPLICATION

This application is based upon and claims the benefit of priority of the prior Japanese Patent Application No. 2014-155462, filed on Jul. 30, 2014, the entire contents of which are incorporated herein by reference.

FIELD

The embodiments discussed herein are related to an image recording device.

BACKGROUND

In an image recording device that conducts a recording process (printing process) by ejecting ink, poor ejection, in which the inherently-expected amount of ink is not ejected or ink is not ejected to target spots, or ejection failure, in which ink is not ejected at all, can sometimes occur in the recording process.

Poor ejection or ejection failure can be caused by a foreign body such as paper powder etc. generated from media such as print sheets or the like attached to the ink ejection outlet or to the periphery of the ink ejection outlet. Poor ejection or ejection failure can also be caused in a situation where a minute droplet scattering during ejection is attached to the ink ejection outlet, breaking the surface tension shape (meniscus shape) of the ink, making a bubble block the ink ejection outlet or causing other influence. Further, also in a case when ink has not been ejected for a long period of time, the increased viscosity of the ink can cause poor ejection or ejection failure.

As a method of recovering from poor ejection or ejection failure and preventing them from occurring, for example, a method in which a foreign body or a bubble is discharged together with ink by causing suction from the ink ejection outlet or pressure from the ink supplying side, a method in which a flexible member is pressed on the ejection surface so as to wipe a foreign body or a bubble, and other methods are known. An image recording device uses these methods in order to conduct maintenance for maintaining and restoring the ink ejection function.

Although maintenance is also conducted when receiving instructions from users, image recording devices are also configured to conduct maintenance automatically when the number of printed sheets has exceeded a prescribed value or a period of time that has elapsed has exceeded a prescribed value since the previous maintenance. Hereinafter, maintenance that is conducted automatically is referred to as automatic maintenance.

Regarding automatic maintenance, Patent Document 1 for example discloses an image recording device that conducts automatic maintenance when a recording process in a unit that leads to good user workability has been terminated.

[Patent Document 1] Japanese Laid-open Patent Publication No. 2008-68438

SUMMARY

The method proposed by Patent Document 1 above only pays attention to a unit that leads to good user workability and does not at all consider setting regarding image quality. Accordingly, when high quality is required for the printing of a job whose processing is interrupted so as to conduct automatic maintenance, a great difference occurs in image quality between before and after the automatic maintenance, leading to user frustration.

In view of the above situation, according to one aspect, an image recording device includes a maintenance mechanism that conducts maintenance for maintaining and recovering an ink ejection function of a recording head that conducts a printing process on a print medium and a maintenance mechanism control unit that makes the maintenance mechanism conduct the maintenance at termination or start of one of process-target jobs for which a cumulative number of sheets of the media that received printing processes by the recording head after an immediately previous maintenance will reach a lower limit of the cumulative number of sheets, which represents an earliest start timing of the maintenance, and will not reach an upper limit of the cumulative number of sheets, which represents a latest start timing of the maintenance, during a printing process, in which the maintenance mechanism control unit makes the maintenance mechanism conduct the maintenance before start of printing of a process-target job when a priority on image quality, which requires high quality printing, is set in the process-target job and the cumulative number of sheets reaches the lower limit during a printing process of the process-target job.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 5 shows an example of start timing management information according to embodiment 1;

FIGS. 10 (A)-(D) show examples of start timing management information that correspond to the specific examples shown in FIG. 9;

DESCRIPTION OF EMBODIMENTS

Figure 1:
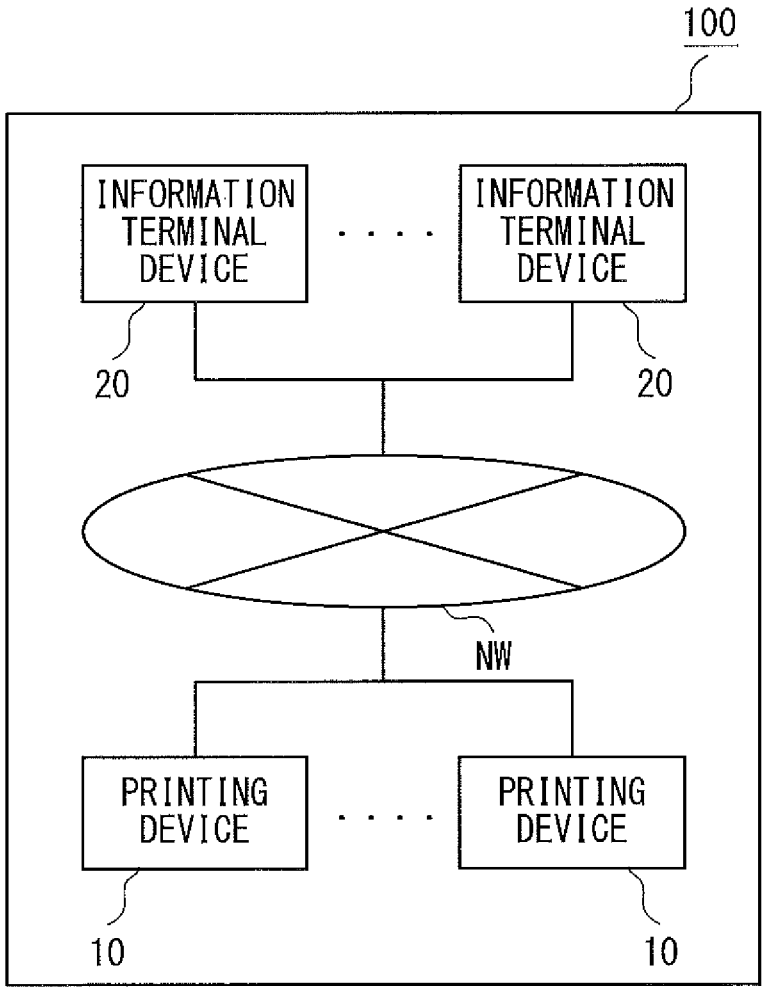
FIG. 1 shows a configuration example of a printing system according to embodiment 1.

Hereinafter, detailed explanations will be given for the embodiments of the present invention by referring to the drawings.

(Embodiment 1)

FIG. 1 shows a configuration example of a printing system 100 according to present embodiment 1. As shown in FIG. 1, the printing system 100 includes one or a plurality of printing devices 10, which are image recording devices, and one or a plurality of information terminal devices 20, which output printing jobs (hereinafter referred to as jobs simply) in accordance with an instruction from a user, and the printing devices 10 and the information terminal devices 20 are connected via network NW in such a manner that communication is possible to each other.

Figure 2A:
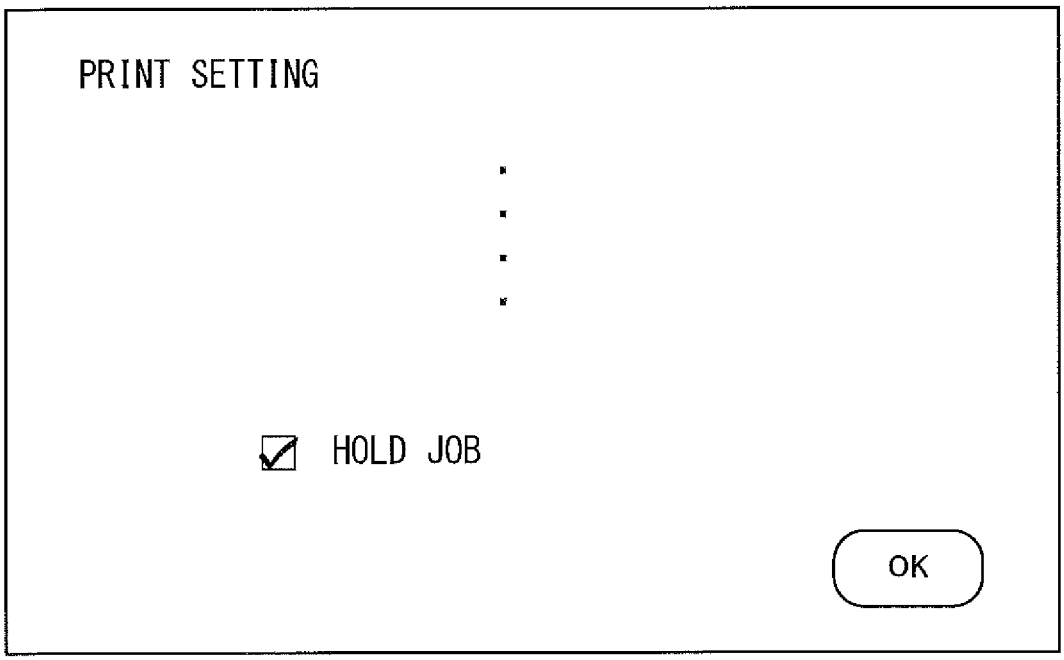
FIG. 2A shows an example of a print setting window according to embodiment 1.
Figure 2B:
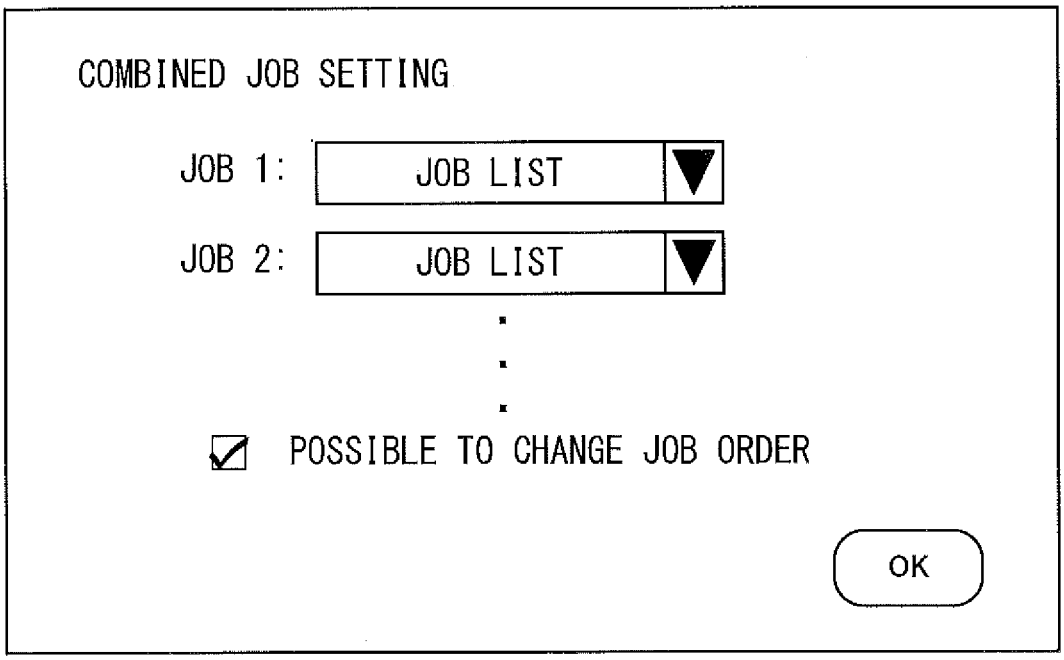
FIG. 2B shows an example of a combined job setting window according to embodiment 1.

FIG. 2A shows an example of a print setting window according to present embodiment 1, and FIG. 2B shows an example of a combined job setting window according to present embodiment 1.

The print setting window shown in FIG. 2A is an example of a print setting window displayed on for example the display screen of the information terminal device 20. A print setting window in present embodiment 1 is a window for conducting print setting of a process target, and includes at least a checkbox for "Hold job" as shown in FIG. 2A.

The checkbox for "Hold job" is a checkbox for making a job storage unit 12*a* (which will be explained later in detail) of the printing device 10 store a corresponding job. By checking the checkbox for "Hold job", the corresponding job is stored in the job storage unit 12*a* of the printing device 10. Note that it is also possible to manipulate a manipulation unit 14 (which will be explained later in detail) and thereby store in the job storage unit 12*a* a job stored in a portable storage device such as a USB (Universal Serial Bus) memory etc. connected to the printing device 10.

The combined job setting window shown in FIG. 2B is an example of a combined job setting window that is displayed on for example the display screen of the information terminal device 20 or the display screen of a display unit 13 (which will be explained later in detail) of the printing device 10. The combined job setting window according to present embodiment 1 is a window for setting combined jobs and has at least a "selection box" and a checkbox for "possible to change job order" as shown in FIG. 2B.

A combined job is a job that has been formed into one job as a result of combining a plurality of jobs. Jobs are combined in accordance with the order selected in the combined job setting window. In a case when for example job A and job B have been selected in the order of job B and job A, the combined job is a job formed by combining jobs A and B in the order of job B and job A. Hereinafter, a combined job formed in the order of job B and job A will be referred to as a combined job (B, A).

The "selection box" is configured to allow selection of a plurality of jobs from among a plurality of jobs stored in the job storage unit 12*a* in a manner that the selected jobs are associated with the selection orders.

The checkbox for "possible to change job order" is a checkbox that is to be checked when there is no need to print jobs in the selected order. Cases where the checkbox for "possible to change job order" is checked include, among others, a case where for example it is not necessary to print a plurality of jobs in a lump in order to generate a single document whereas it is necessary to prevent the mixing of other people's printed sheets.

Figure 3:
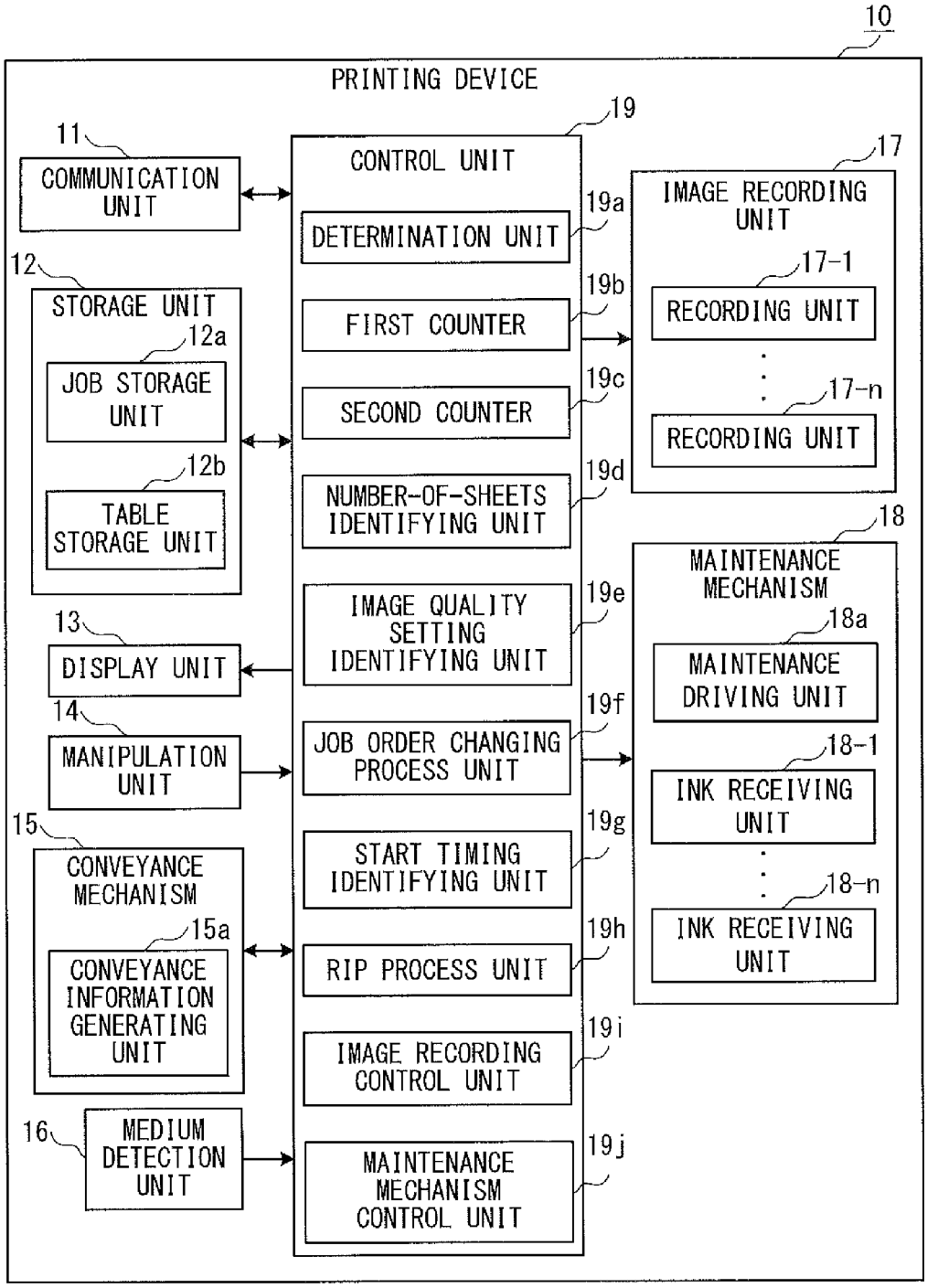
FIG. 3 is a functional block diagram showing a configuration example of printing devices, which are constituents of a printing system according to embodiment 1.
Figure 4A:
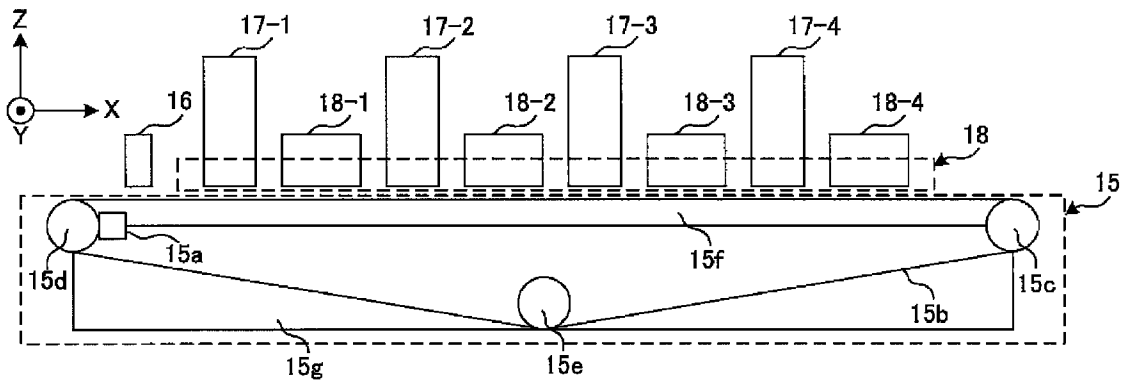
FIG. 4A shows an arrangement example of main functional units that are related to image recording in embodiment 1.
Figure 4B:
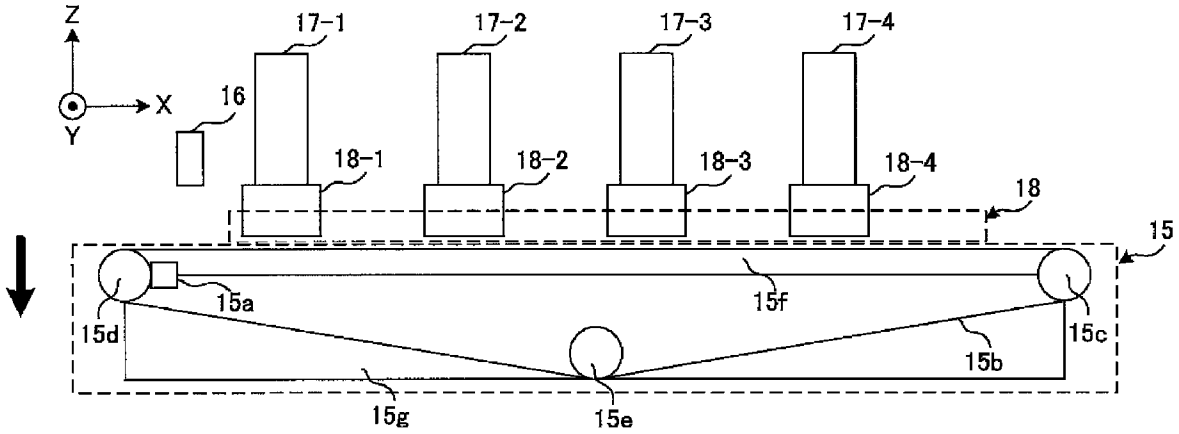
FIG. 4B shows operations conducted during automatic maintenance according to embodiment 1.

Next, the printing device 10 according to present embodiment 1 will be explained by referring to FIG. 3 and FIG. 4. FIG. 3 is a functional block diagram showing a configuration example of the printing devices 10, which are constituents of the printing system 100 according to present embodiment 1. FIG. 4A shows an arrangement example of main functional units that are related to image recording in the present embodiment 1. FIG. 4B shows operations conducted during automatic maintenance.

The printing device 10 according to present embodiment 1 is for example a device that processes combined jobs and print those combined jobs on media such as print sheets etc. so as to output the sheets, and includes a communication unit 11, a storage unit 12, a display unit 13, a manipulation unit 14, a conveyance mechanism 15, a medium detection unit 16, an image recording unit 17, a maintenance mechanism 18, and a control unit 19. Note that explanations will hereinafter be given on an assumption that process targets are combined jobs.

The communication unit 11 includes a communication module etc., and conducts communications with the information terminal device 20 via network NW. The communication unit 11 receives for example jobs output from the information terminal device 20.

The storage unit 12 includes a RAM (Random Access Memory), a ROM (Read Only Memory), an HDD (Hard Disk Drive), a non-volatile memory, etc., and functions as a work area for a CPU (Central Processing Unit) that is a constituent of the control unit 19, a program area that stores various types of programs such as an operation program for controlling the entire printing device 10 and a data area that stores various types of data such as a first threshold representing an appropriate prescribed number of sheets (which will be described later in detail), a second threshold representing a maximum prescribed number of sheets (which will be described later in detail), etc. Also, the data area has in advance stored values resulting from respectively converting the intervalic distances into the cumulative numbers of pulses of an rotary encoder (which will be described later in detail), the intervalic distances being from the medium detection unit 16 to the respective nozzle arrays in the recording units 17-1 through **17-*n* (which will be described later in detail) of the image recording unit 17**.

Also, as shown in FIG. 3, the storage unit 12 functions as a job storage unit **12*a* and a table storage unit 12*b*. The job storage unit 12*a* is a storage unit that stores a job for which the checkbox for "Hold job" has been checked in the print setting window exemplified in FIG. 2**A.

The table storage unit **12*b* is a storage unit that stores a table or the like, and stores start timing management table T1** in present embodiment 1.

FIG. 5 shows an example of start timing management information according to present embodiment 1. The example shown in FIG. 5 is an example in the form of a table. Start timing management table T1 according to present embodiment 1 is a table that manages the start timing of automatic maintenance and is a table on which "image quality priority flag" and "start flag" are associated to each other for each "job".

The numbers in the "job" column represent the orders at which the jobs that are constituents of a combined job (referred to as constituent jobs hereinafter) are combined, i.e., selection orders. Note that when the order of constituent jobs was changed, the numbers in the "job" column represent the orders at which the constituent jobs are combined after the change.

An "image quality priority flag" is a flag representing whether or not "image quality setting" has been set to priority on image quality in the corresponding constituent job. In present embodiment 1, the flag value of "0" represents that "image quality setting" has not been set to priority on image quality and the flag value of "1" represents that "image quality setting" has been set to priority on image quality.

A "start flag" is a flag representing whether or not automatic maintenance is to be conducted immediately before the printing process of the corresponding constituent job. In present embodiment 1, the flag value of "0" represents that automatic maintenance is not to be conducted and the flag value of "1" represents that automatic maintenance is to be conducted. It is assumed that the initial value of "start flag" is set to "0".

Next, explanations will be given for the "appropriate prescribed number of sheets". The "appropriate prescribed number of sheets" is an inherent reference value for the cumulative number of sheets that triggers automatic maintenance, and employs as the initial value a number of sheets determined on the basis of for example a durability experiment. Note that because an appropriate prescribed number of sheets that triggers automatic maintenance differs depending upon use environments from one user to another, the "appropriate prescribed number of sheets" may be changed by users. The "maximum prescribed number of sheets" is the upper limit value for a cumulative number of sheets that triggers automatic maintenance, i.e., a value that defines the upper limit of the start timing of automatic maintenance. That is, "appropriate prescribed number of sheets"<"maximum prescribed number of sheets" is satisfied. In other words, the "appropriate prescribed number of sheets" is the lower limit of a cumulative number of sheets representing the earliest start timing of maintenance while the "maximum prescribed number of sheets" is the upper limit of a cumulative number of sheets representing the latest start timing of maintenance.

A cumulative number of sheets is the number of sheets that received printing processes after the previous automatic maintenance was conducted, and two-sided printing is counted as two sheets. Note that it is also possible to correct the number of sheets in accordance with the size of sheets or the types of media on which printing is conducted. As an example, A-4 size sheet is treated as the reference size and an A-3 size sheet is counted as two sheets.

Referring to FIG. 3 again, the display unit 13 includes a display device etc. such as an LCD (Liquid Crystal Display), an organic EL (Electro-Luminescence) display device, etc., and displays for example various types of setting windows, various types of function buttons, etc. on the display screen.

The manipulation unit 14 includes a numeric keypad, a touch panel to be displayed on the display screen of the display unit 13, etc., and users are allowed to execute desired processes by manipulating the manipulation unit 14 to input instructions to the printing device 10.

As shown in FIG. 4A, the conveyance mechanism 15 has a configuration in which an endless belt in a conveyance member **15*b* is threaded on a driving roller 15*c* and driven rollers 15*d* and 15*e*, the conveyance member 15*b* being a member on which print sheets provided by a sheet feeding unit (not shown) is mounted. The driving roller 15*c* and the driven rollers 15*d* and 15*e* are provided in a mechanism body 15*g* having a platen 15*f*** in such a manner that they are allowed to roll.

The driving roller **15*c* is driven by for example a motor (not shown) under control of the control unit 19, and print sheets mounted on the conveyance member 15*b* are conveyed to the downstream side of the conveyance route. The mechanism body 15*g* has a suction fan (not shown) and is configured in such a manner that print sheets are suctioned via the conveyance member 15*b* and the platen 15*f* under control of the control unit 19. Also, the conveyance mechanism 15 is sustained by a sustaining member (not shown) that can move vertically so that it can move vertically to a prescribed position under control of the control unit 19**.

As shown in FIG. 3, the conveyance mechanism 15 has a conveyance information generating unit **15*a*. The conveyance information generating unit 15*a* includes for example a rotary encoder provided to the driven roller 15*d*, and generates, triggered by input of detection information from the medium detection unit 16, conveyance information each time a print sheet is conveyed over a prescribed distance by the conveyance mechanism 15, and thereafter outputs the generated conveyance information to an image recording control unit 19*i* (which will be described later). In other words, the rotary encoder of the conveyance information generating unit 15*a* generates, triggered by input of detection information from the medium detection unit 16, a pulse signal corresponding to the amount of movement of the conveyance member 15*b* so as to output the generated pulse signal to the image recording control unit 19*i*** as conveyance information.

The medium detection unit 16 includes for example a transmission type sensor, a reflection type sensor, etc., and detects at least the leading edge of a sheet mounted on the conveyance mechanism 15. The medium detection unit 16 is arranged at a prescribed location on the upper stream side than the recording units 17-1 through **17-*n* on the conveyance route, and detects the leading edge of a print sheet facing the conveyance direction so as to output to the conveyance information generating unit 15***a* detection information indicating that the leading edge of a print sheet has been detected.

The image recording unit 17 conducts, under control of the image recording control unit 19*i*, a recording process (printing process) on a print sheet on the basis of raster data generated by an RIP process unit 19*h* (which will be described later in detail). As shown in FIG. 3, the image recording unit 17 includes the recording units 17-1 through 17-*n* (n is an integer equal to or greater than two), and the recording units 17-1 through 17-*n* are provided in such a manner that the recording units 17-1 through 17-*n* are above the conveyance mechanism 15 and face the conveyance mechanism 15 as shown in FIG. 4. The recording units 17-1 through 17-*n* are configured to include line heads (not shown) each having at least one nozzle array for each ink color of for example black (K), cyan (C), magenta (M) and yellow (Y) in the order from the upstream side to the downstream side in the conveyance direction of print sheets.

As shown in FIG. 3, the maintenance mechanism 18 includes for example a maintenance driving unit 18*a*, ink receiving units 18-1 through 18-*n* (n is an integer equal to or greater than two), etc., and conducts automatic maintenance in order to maintain and recover the ink ejection function of each recording head of line heads with the maintenance driving unit 18*a* controlled and driven by a maintenance mechanism control unit 19*j* (which will be described later).

The ink receiving units 18-1 through 18-*n* are for receiving ink discharged from each recording head provided to the recording units 17-1 through 17-*n* during automatic maintenance. While the printing device 10 is conducting a printing process, the ink receiving units 18-1 through 18-*n* are retracted to the spaces between the recording units 17-1 through 17-*n* as shown in FIG. 4A so that the printing process is not prevented.

During automatic maintenance, the ink receiving units 18-1 through 18-*n* are moved to the positions that face the respective recording heads provided to the recording units 17-1 through 17-*n* as shown in FIG. 4B. The recording units 17-1 through 17-*n* discharge ink by for example applying pressure from each recording head when the ink receiving units 18-1 through 18-*n* are at the above positions so that automatic maintenance for maintaining and recovering the function of ejecting ink is conducted.

By referring to FIG. 3 again, the control unit 19 includes a CPU (computer) etc., and executes an operation program stored in the program area of the storage unit 12 so as to implement the functions as a determination unit 19*a*, a first counter 19*b*, a second counter 19*c*, a number-of-sheets identifying unit 19*d*, an image quality setting identifying unit 19*e*, an job order changing process unit 19*f*, a start timing identifying unit 19*g*, an RIP process unit 19*h*, an image recording control unit 19*i* and a maintenance mechanism control unit 19*j*, and conducts a control process of controlling the entire printing device 10, a start timing identifying process, which will be described later in detail, and other processes.

The determination unit 19*a* conducts various types of determination processes. For example, the determination unit 19*a* determines whether or not a combined job has been input. More specifically, the determination unit 19*a* determines whether or not a combined job received by the communication unit 11 or a combined job formed by the setting in the combined job setting window displayed on the display screen of the display unit 13 has been input to the control unit 19.

Also, the determination unit 19*a* determines whether or not counter value i of the first counter 19*b* has exceeded a first threshold. In other words, the determination unit 19*a* determines whether or not the cumulative number of sheets at the current moment has exceeded the appropriate prescribed number of sheets. The determination unit 19*a* also determines whether or not counter value i of the first counter 19*b* will reach the first threshold during the printing of a process-target combined job. In other words, the determination unit 19*a* determines whether or not the cumulative number of sheets will reach the appropriate prescribed number of sheets during the printing of the process-target combined job. More specifically, the determination unit 19*a* determines that the appropriate prescribed number of sheets will be reached during the printing when a value is equal to or greater than the appropriate prescribed number of sheets, the value being obtained by adding the number of the sheets to be printed for all the constituent jobs identified by the number-of-sheets identifying unit 19*d* to the cumulative number of sheets (counter value i of the first counter 19*b*) at the current moment. The fact that the cumulative number of sheets will reach the appropriate prescribed number of sheets during printing means that the inherent start timing of automatic maintenance will arrive during the printing.

The determination unit 19*a* also determines whether or not the flag value of the "start flag" corresponding to job k is "1". "k" of "job k" corresponds to a number in the "job" column in start timing management table T1, and for example the constituent job corresponding to number "2" in the "job" column is job 2. In other words, job k is a k-th constituent job among constituent jobs that constitute a process-target combined job (in a case when the order has been changed, a process-target combined job after the change).

The determination unit 19*a* also determines whether or not there is an unprocessed constituent job among the constituent jobs that constitute the combined job. More specifically, the determination unit 19*a* determines that there is an unprocessed constituent job when counter value k (which corresponds to "k" of job k) of the second counter has not reached the number of entries in start timing management table T1. When counter value k of the second counter has reached the number of entries in start timing management table T1, the determination unit 19*a* determines that there is not an unprocessed constituent job.

The first counter 19*b* is a counter that manages the cumulative number of sheets, and is controlled by the control unit 19. When start timing of automatic maintenance has arrived, the first counter 19*b* is initialized (counter value i=0) by the control unit 19. Also, the first counter 19*b* is incremented by the control unit 19 each time image recording (printing) is conducted on a print sheet.

The second counter 19*c* is a counter that manages whether or not all the constituent jobs that constitute a process-target combined job has received printing processes, and is controlled by the control unit 19. When an automatic maintenance process (which will be described later) has been started, the second counter 19*c* is initialized (counter value k=1) by the control unit 19. Also, the second counter 19*c* is incremented by the control unit 19 each time a constituent job receives a printing process.

The number-of-sheets identifying unit 19*d* identifies the number of the sheets to be printed for each constituent job by analyzing the process-target combined job. In case of two-sided printing, the number-of-sheets identifying unit 19*d* counts each of the two sides of a print sheet. In other words, when printing has been conducted on both sides of a print sheet, the number-of-sheets identifying unit 19*d* counts that print sheet as two print sheets.

The image quality setting identifying unit 19*e* manages start timing management table T1 and identifies the "image quality setting" of a constituent job. More specifically, the image quality setting identifying unit 19*e* initializes start timing management table T1 when the cumulative number of sheets has already exceeded the appropriate prescribed number of sheets or when cumulative number of sheets reaches the appropriate prescribed number of sheets during the printing of a process-target combined job. Then, the image quality setting identifying unit 19*e* registers in start timing management table T1 as many entries as there are constituent jobs.

Then, the image quality setting identifying unit 19*e* determines whether the "image quality setting" of each constituent job is priority on image quality or no priority on image quality. For example, the image quality setting identifying unit 19*e* determines that the "image quality setting" of a constituent job having an object at a prescribed gray scale or higher or with prescribed resolution or higher is priority on image quality. Also, for example, the image quality setting identifying unit 19*e* determines that the "image quality setting" of a constituent job for which "priority on image quality" has been set in the print setting is priority on image quality. The image quality setting identifying unit 19*e* determines, to be no priority on image quality, the "image quality setting" of a constituent job that is not a constituent job determined to be priority on image quality.

Thereafter, the image quality setting identifying unit 19*e* sets to "1" the flag value of the corresponding "image quality priority flag" in start timing management table T1 when the identified "image quality setting" is priority on image quality, and sets to "0" the flag value of the corresponding "image quality priority flag" in start timing management table T1 when the identified "image quality setting" is no priority on image quality.

When it is possible to change the order of constituent jobs, the job order changing process unit 19*f* changes the order of constituent jobs. More specifically, the job order changing process unit 19*f* in present embodiment 1 moves a constituent job identified by the image quality setting identifying unit 19*e* as a job with no priority on image quality to a position earlier than constituent jobs with priority on image quality.

In a case for example when the process-target combined job is a combined job (1, 2, 3, 4) with jobs 1 and 3 being with priority on image quality and jobs 2 and 4 being with no priority on image quality, the job order changing process unit 19*f* according to present embodiment 1 moves jobs 2 and 4 with no priority on image quality to positions earlier than jobs 1 and 3. In such a case, the job order changing process unit 19*f* does not change the job order between constituent jobs with priority on image quality or between constituent jobs with no priority on image quality. Accordingly, the combined job after the order change in this example is a combined job (2, 4, 1, 3). As a matter of course, it is also possible to employ a configuration in which order change can be conducted even between constituent jobs with priority on image quality or between constituent jobs with no priority on image quality.

The start timing identifying unit 19*g* identifies the start timing of automatic maintenance (constituent job that is to be printed immediately after the automatic maintenance). Then, the start timing identifying unit 19*g* sets to "1" the flag value of the "start flag", in the start timing management table T1, that corresponds to the identified constituent job.

More specifically, the start timing identifying unit 19*g* refers to start timing management table T1 and determines whether or not to print a constituent job with priority on image quality after the appropriate prescribed number of sheets on the basis of the number of the sheets to be printed for each constituent job identified by the number-of-sheets identifying unit 19*d*, the counter value i of the first counter 19*b* at the current moment and the first threshold that represents the appropriate prescribed number of sheets. At that moment, the start timing identifying unit 19*g* determines to print a constituent job with priority on image quality after the appropriate prescribed number of sheets when the appropriate prescribed number of sheets is exceeded during the printing of a constituent job with priority on image quality.

More specifically, the start timing identifying unit 19*g* identifies a constituent job with priority on image quality by searching the "image quality priority flag" column in the start timing management table T1, and calculates the number of the sheets to be printed before the identified constituent job with priority on image quality. Then, the start timing identifying unit 19*g* determines whether or not a value has exceeded the first threshold, the value being obtained by adding the values of the calculated numbers of the sheets to be printed to counter value i (referred to as an expected cumulative number of sheets hereinafter).

For example, the start timing identifying unit 19*g* identifies jobs 2 and 3 as constituent jobs with priority on image quality in start timing management table T1, which is exemplified in FIG. 5. Then, the start timing identifying unit 19*g* determines whether or not a value obtained by adding the numbers of the sheets to be printed for jobs 1 and 2 to counter value i (the expected cumulative number of sheets for job 2) has exceeded the first threshold and whether or not a value obtained by adding the numbers of the sheets to be printed for jobs 1 through 3 to counter value i (the expected cumulative number of sheets for job 3) has exceeded the first threshold.

When it has been determined not to print a constituent job with priority on image quality after the appropriate prescribed number of sheets, the start timing identifying unit 19*g* further determines whether or not the maximum prescribed number of sheets will be exceeded during the printing of the process-target combined job. More specifically, when the expected cumulative number of sheets for the latest job in the process-target combined job exceeds the second threshold, the start timing identifying unit 19*g* determines that the maximum prescribed number of sheets will be exceeded during the printing of the process-target combined job. When the expected cumulative number of sheets for the latest constituent job of the process-target combined job does not exceed the second threshold, the start timing identifying unit 19*g* determines that the maximum prescribed number of sheets will not be exceeded during the printing of the process-target combined job.

For example, in start timing management table T1, exemplified in FIG. 5, the start timing identifying unit 19*g* determines whether or not a value obtained by adding, to counter value i, a value obtained by adding the numbers of the sheets to be printed respectively for jobs 1 through 3 (an expected cumulative number of sheets for job 3) has exceeded the second threshold.

When it has been determined that the maximum prescribed number of sheets will be exceeded during the printing of the process-target combined job, the start timing identifying unit 19*g* identifies a constituent job whose expected cumulative number will reach the maximum prescribed number of sheets during the printing, and sets to "1" the flag value of the "start flag" corresponding to the identified constituent job. When it has been determined that the maximum prescribed number of sheets will not be exceeded during the printing of the process-target combined job, the start timing identifying unit 19*g* does not identify the start timing of automatic maintenance during the present process-target combined job. In other words, automatic maintenance will not be conducted during the printing of the present process-target combined job.

When it has been determined to print a constituent job with priority on image quality after the appropriate prescribed number of sheets, the start timing identifying unit 19*g* identifies the first constituent job among constituent jobs with priority on image quality that are to be printed after the appropriate prescribed number of sheets. For example, in start timing management table T1, exemplified in FIG. 5, when it has been determined to print jobs 2 and 3 after the appropriate prescribed number of sheets, the start timing identifying unit 19*g* identifies job 2.

Then, the start timing identifying unit 19*g* determines whether or not to start the printing of the identified constituent job (with priority on image quality) after the maximum prescribed number of sheets. More specifically, the start timing identifying unit 19*g* determines whether or not the expected cumulative number of sheets for the constituent job immediately previous to the identified constituent job (with priority on image quality) has exceeded the second threshold. For example, in start timing management table T1, exemplified in FIG. 5, when it has been determined to print jobs 2 and 3 after the appropriate prescribed number of sheets, the start timing identifying unit 19*g* determines whether or not a value obtained by adding, to counter value i, the value of the printed sheets for job 1, which is the constituent job immediately previous to job 2, (an expected cumulative number of sheets for job 1) has exceeded the second threshold.

When it has been determined not to start the printing of the identified constituent job (with priority on image quality) after the maximum prescribed number of sheets, the start timing identifying unit 19*g* sets to "1" the flag value of the "start flag" corresponding to the identified constituent job (with priority on image quality).

When it has been determined to start the printing of the identified constituent job (with priority on image quality) after the maximum prescribed number of sheets, the start timing identifying unit 19*g* further identifies a constituent job whose expected cumulative number will reach the maximum prescribed number of sheets during the printing. Then, the start timing identifying unit 19*g* sets to "1" the flag value of the "start flag" that corresponds to the identified constituent job.

The RIP process unit 19*h* generates raster data by conducting an RIP process on the process-target combined job.

The image recording control unit 19*i* controls the image recording unit 17 so that the image recording unit 17 conducts a recording process (printing process) on a print sheet. More specifically, the image recording control unit 19*i* controls the image recording unit 17 so that the image recording unit 17 conducts a recording process (printing process) on a print sheet at a timing when the cumulative number of pulses of a rotary encoder output triggered by the detection by the medium detection unit 16 of the leading edge of a conveyed print sheet becomes identical to the cumulative number of pulses corresponding to the intervallic distance from the medium detection unit 16 to each nozzle array of the recording units 17-1 through 17-*n*, the intervallic distance having been stored in the data area in advance.

The maintenance mechanism control unit 19*j* controls the maintenance mechanism 18 so that the maintenance mechanism 18 conducts automatic maintenance. More specifically, when the flag value of the "start flag" of job k that corresponds to counter value k of the second counter 19*c* has been determined to be "1" by the determination unit 19*a*, the maintenance mechanism control unit 19*j* controls the maintenance mechanism 18 so that the maintenance mechanism 18 conducts automatic maintenance.

Figure 6:
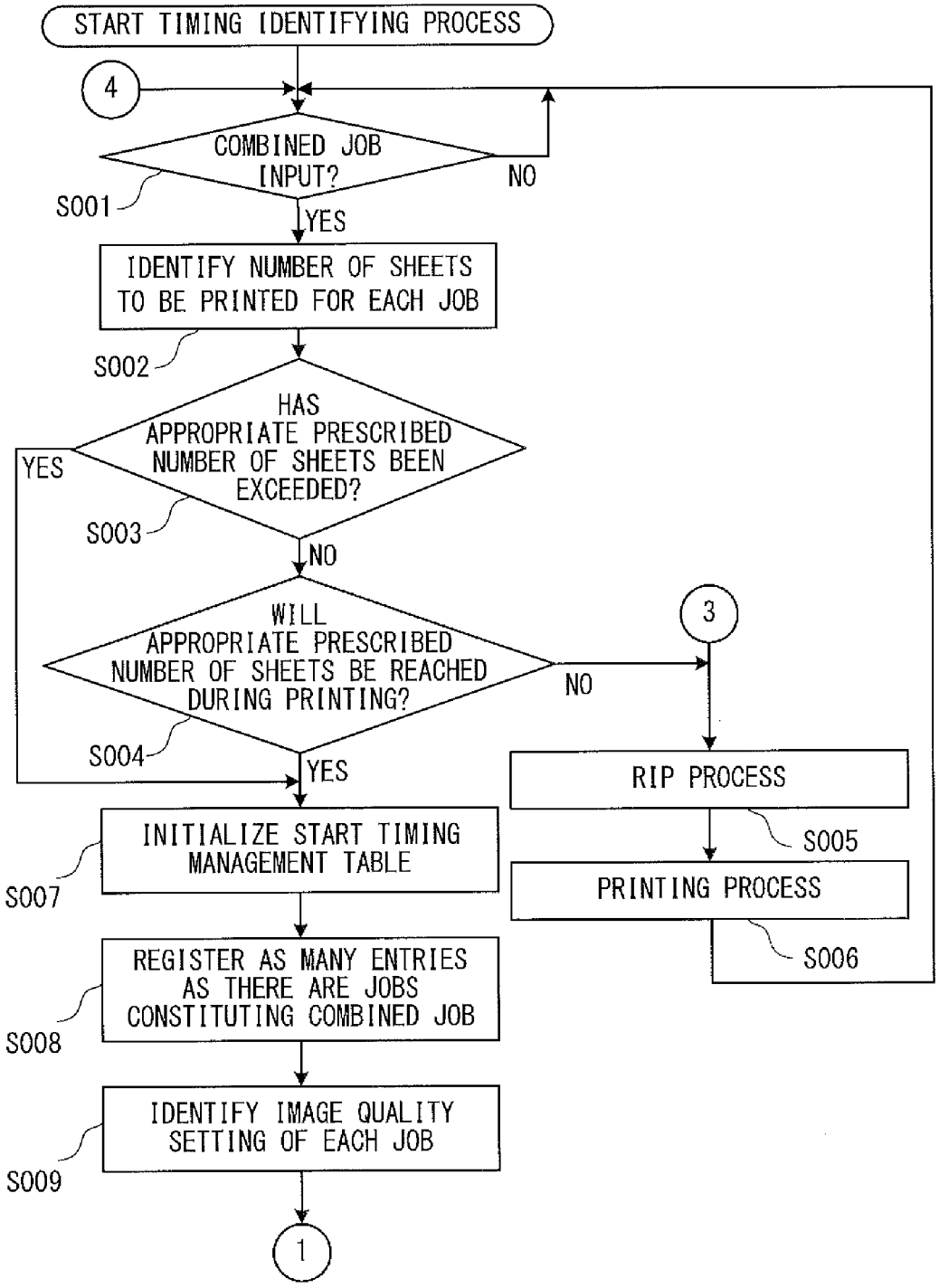
FIG. 6 shows part of an example of a flowchart for explaining a flow of a start timing identifying process according to embodiment 1.
Figure 7:
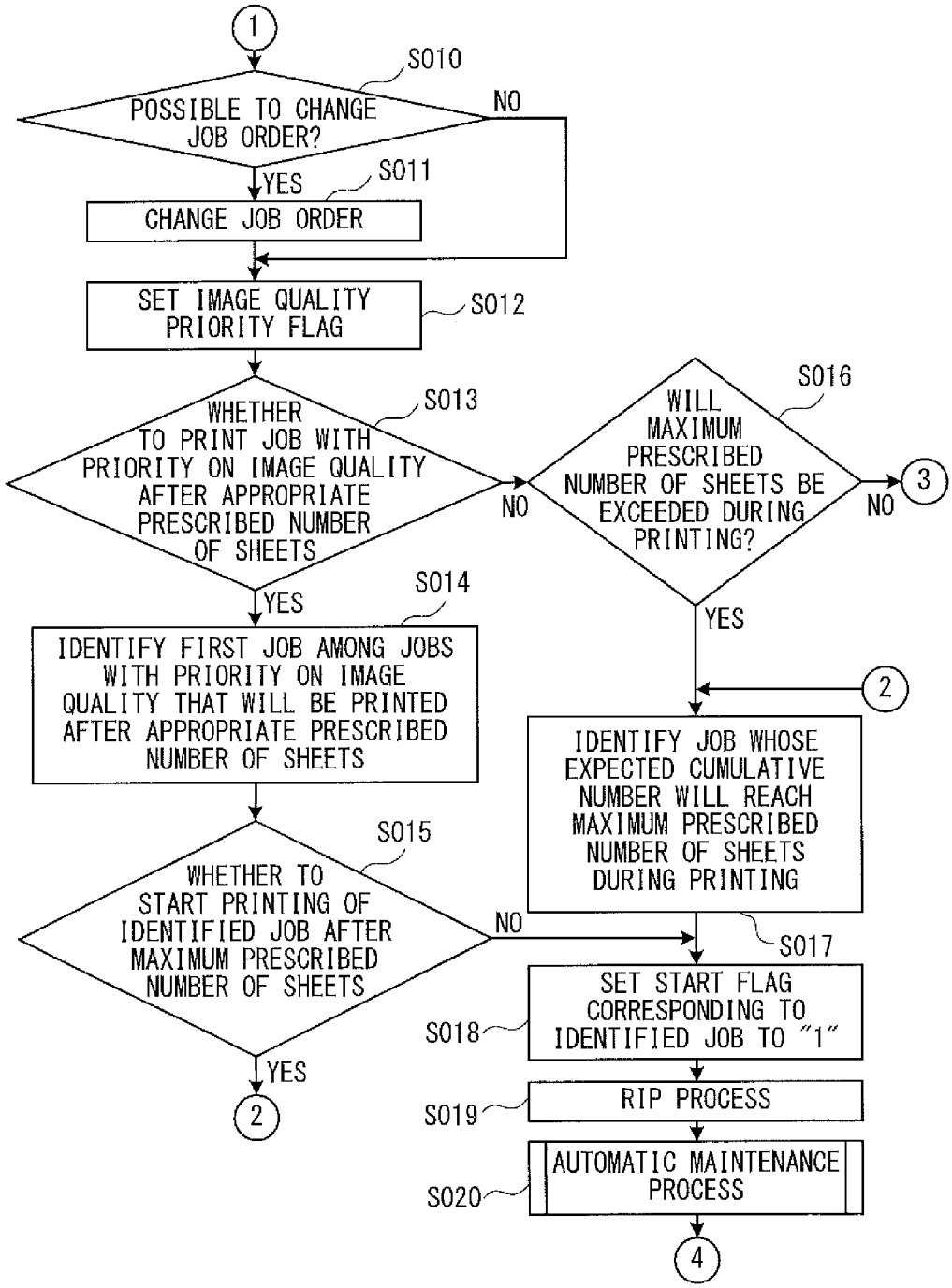
FIG. 7 shows the rest of the flowchart for explaining the flow of the start timing identifying process according to embodiment 1.

Next, by referring to FIG. 6 and FIG. 7, explanations will be given for a flow of a start timing identifying process according to present embodiment 1. FIG. 6 shows part of an example of a flowchart for the explanations for a flow of the start timing identifying process according to present embodiment 1 and FIG. 7 shows the rest of it. This start timing identifying process is triggered by input of a combined job.

The determination unit 19*a* determines whether or not a combined job has been input (step S001). When it has been determined by the determination unit 19*a* that a combined job has not been input (No in step S001), the process repeats the process in step S001 and waits for a combined job to be input.

When it has been determined by the determination unit 19*a* that a combined job has been input (Yes in step S001), the number-of-sheets identifying unit 19*d* analyzes the combined job so as to identify the number of the sheets to be printed for each constituent job (step S002). Then, the determination unit 19*a* determines whether or not the cumulative number of sheets at the current moment has exceeded the appropriate prescribed number of sheets (step S003).

When it has been determined by the determination unit 19*a* that the appropriate prescribed number of sheets has been exceeded (Yes in step S003), the process proceeds to step S007, which will be described later. When it has been determined that the appropriate prescribed number of sheets has not been exceeded (No in step S003), the determination unit 19*a* further determines whether or not the appropriate prescribed number of sheets will be reached during the printing of the process-target combined job (step S004).

When it has been determined by the determination unit 19*a* that the appropriate prescribed number of sheets will not be reached during the printing (No in step S004), the start timing is not identified because automatic maintenance will not be conducting during the printing of the process-target combined job, and the RIP process unit 19*h* conducts an RIP process on the process-target combined job so as to generate raster data (step S005). Then, the image recording control unit 19*i* controls the image recording unit 17 so that the image recording unit 17 conducts a recording process (printing process) on a print sheet on the basis of raster data (step S006). Then, the process returns to step S001, and repeats the processes described above.

When it has been determined by the determination unit 19*a* that the appropriate prescribed number of sheets will be reached during printing (Yes in step S004), the image quality setting identifying unit 19*e* initializes start timing management table T1 (step S007) so as to register in start timing management table T1 as many entries as there are constituent jobs that constitute the process-target combined job (step S008). Then, the image quality setting identifying unit 19*e* determines whether the "image quality setting" of each constituent job is priority on image quality or no priority on image quality (step S009).

Then, the determination unit 19*a* determines whether or not the order of the constituent jobs can be changed (step S010). When it has been determined by the determination unit 19*a* that the order cannot be changed (No in step S010), the process proceeds to step S012, which will be described later.

When it has been determined by the determination unit 19*a* that the order can be changed (Yes in step S010), the job order changing process unit 19*f* changes the order of the constituent jobs (step S011). Then, the image quality setting identifying unit 19*e* associates the order of the constituent jobs constituting the process-target combined job with the numbers in the "job" column in start timing management table T1 and sets the flag value of each "image quality priority flag" in accordance with the "image quality setting" identified in the process in step S009 (step S012).

Then, the start timing identifying unit 19*g* determines whether or not to print a constituent job with priority on image quality after the appropriate prescribed number of sheets (step S013). When it has been determined to print a constituent job with priority on image quality after the appropriate prescribed number of sheets (Yes in step S013), the start timing identifying unit 19*g* identifies the first constituent job among constituent jobs with priority on image quality that will be printed after the appropriate prescribed number of sheets (step S014).

Then, the start timing identifying unit 19*g* determines whether or not to start the printing of the identified constituent job (with priority on image quality) after the maximum prescribed number of sheets (step S015). When it has been determined not to start the printing of the identified constituent job (with priority on image quality) after the maximum prescribed number of sheets (No in step S015), the process proceeds to step S018. When it has been determined to start the printing of the constituent job (with priority on image quality) after the maximum prescribed number of sheets (Yes in step S015), the process proceeds to step S017, which will be described later.

When it has been determined not to print a constituent job with priority on image quality after the appropriate prescribed number of sheets (No in step S013), the start timing identifying unit 19*g* further determines whether or not the maximum prescribed number of sheets will be exceeded during the printing of the process-target combined job (step S016). When it has been determined by the start timing identifying unit 19*g* that the maximum prescribed number of sheets will not be exceeded during the printing of the process-target combined job (No in step S016), the process proceeds to step S005 described above. In such a case, because automatic maintenance is not conducted during the printing of the process-target combined job, the start timing is not identified.

When it has been determined that the maximum prescribed number of sheets will be exceeded during the printing of the process-target combined job (No in step S016), the start timing identifying unit 19*g* identifies a constituent job whose expected cumulative number will reach the maximum prescribed number of sheets during the printing (step S017). Then, the start timing identifying unit 19*g* sets to "1" the flag value of the "start flag" corresponding to the identified constituent job in start timing management table T1 (step S018).

Then, the RIP process unit 19*h* generates raster data by conducting an RIP process on the process-target combined job (step S019). Thereafter, the maintenance mechanism control unit 19*j* conducts an automatic maintenance process in cooperation with the image recording control unit 19*i* etc. (step S020). Then, the process returns to step S001 so as to repeat the above process.

Figure 8:
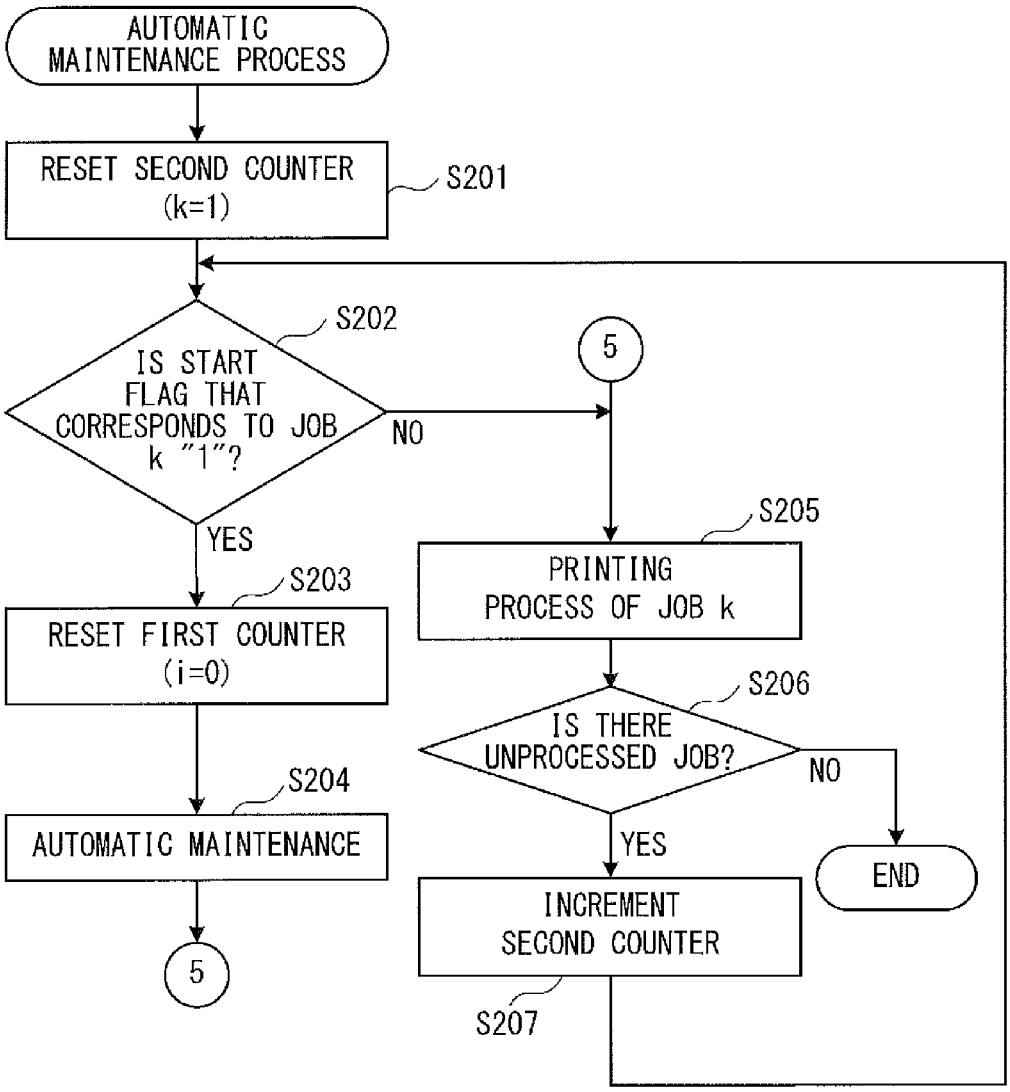
FIG. 8 shows an example of a flowchart for explaining a flow of an automatic maintenance process according to embodiment 1.

Next, by referring to FIG. 8, explanations will be given for a flow of an automatic maintenance process according to present embodiment 1. FIG. 8 shows an example of a flowchart for explaining a flow of an automatic maintenance process according to present embodiment 1. This automatic maintenance process corresponds to the process in step S020 of the start timing identifying process.

The control unit 19 resets the second counter 19*c* (counter value k=1) (step S201). Then, the determination unit 19*a* refers to start timing management table T1 so as to determine whether or not the flag value of the "start flag" of job k corresponding to counter value k is "1" (step S202).

When it has been determined by the determination unit 19*a* that the flag value of the "start flag" of job k is "1" (Yes in step S202), the control unit 19 resets the first counter 19*b* (counter value i=0) (step S203). Then, the maintenance mechanism control unit 19*j* controls the maintenance mechanism 18 so that the maintenance mechanism 18 conducts automatic maintenance (step S204). Thereafter, the process proceeds to step S205.

When it has been determined by the determination unit 19*a* that the flag of the "start flag" of job k is "0" (No in step S202), the image recording control unit 19*i* controls the image recording unit 17 so that the image recording unit 17 conducts a recording process (printing process) on a print sheet for job k on the basis of the generated raster data (step S205).

The determination unit 19*a* determines whether or not there is unprocessed constituent job (step S206). When it has been determined by the determination unit 19*a* that there is not an unprocessed constituent job (No in step S206), the present process is terminated, and process returns to step S001 of the start timing identifying process.

When it has been determined by the determination unit 19*a* that there is an unprocessed constituent job (Yes in step S206), the control unit 19 increments the second counter 19*c* (step S207), and the process returns to step S202 so as to repeat the above process.

Next, by referring to FIG. 9 and FIG. 10 and by using a specific example, explanations will be given for identifying of a start timing in a case when the order in the process-target combined job cannot be changed. FIG. 9(A) through FIG. 9(D) all show specific examples for explaining a start timing of automatic maintenance according to present embodiment 1. FIG. 10(A) through FIG. 10(D) show examples of pieces of start timing management information (start timing management table T1) respectively corresponding to FIG. 9(A) through FIG. 9(D).

Figure 9:
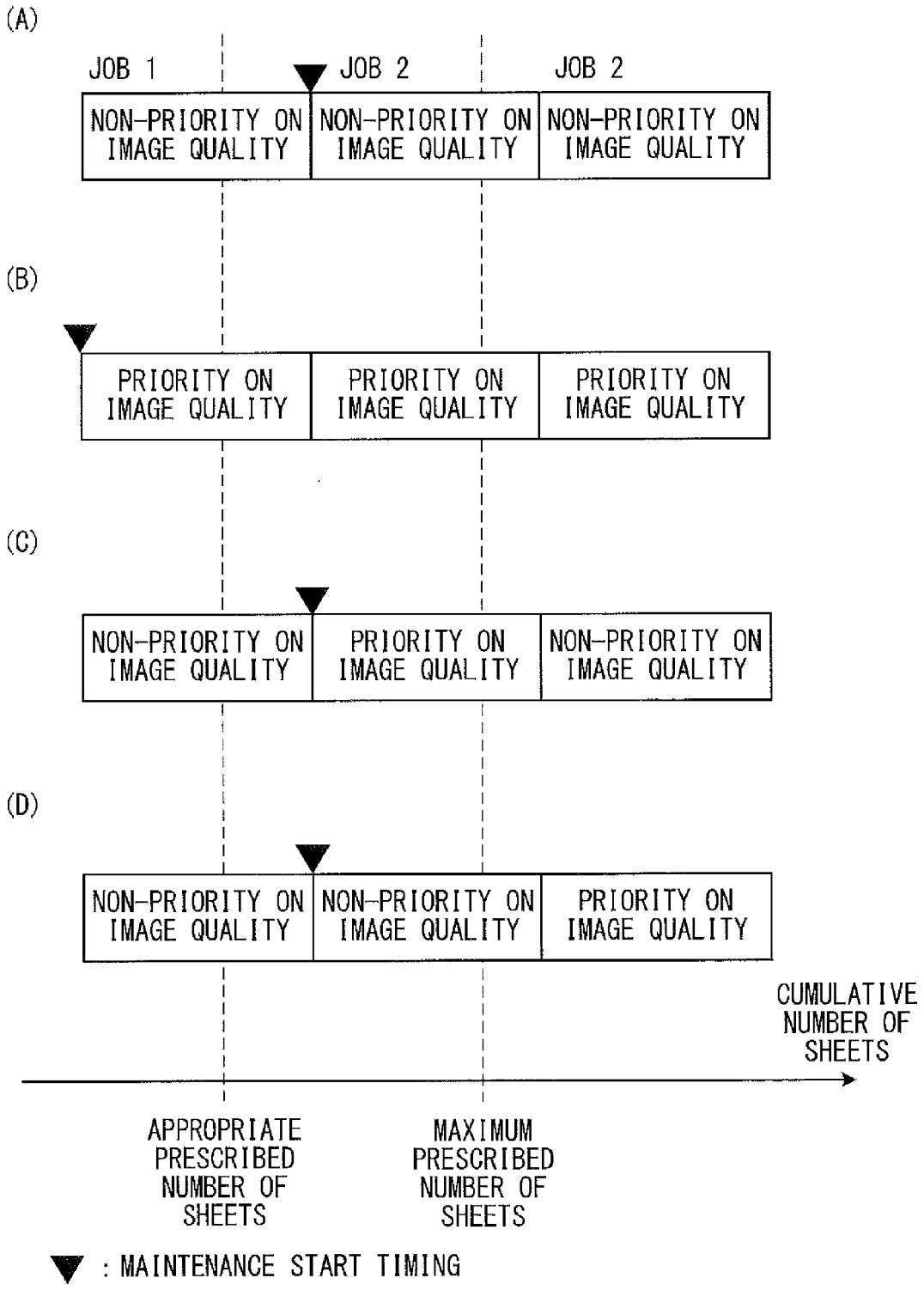
FIG. 9 shows specific examples for explaining start timings of automatic maintenance according to embodiment 1.

The combined job shown in FIG. 9(A) is an example of a combined job including three constituent jobs, with all the constituent jobs with no priority on image quality. It is assumed that the constituent jobs are combined in the order of jobs 1, 2 and 3 starting from the left as shown in FIG. 9.

As shown in FIG. 9, the appropriate prescribed number of sheets will be exceeded in the printing of job 1 (Yes in step S004) and a constituent job with priority on image quality is not printed after the appropriate prescribed number of sheets (No in step S013). Also, because the maximum prescribed number of sheets will be exceeded during the printing of job 2 (Yes in step S016), the start timing identifying unit 19*g* identifies job 2 (step S017).

Accordingly, in start timing management table T1 that corresponds to the specific example shown in FIG. 9(A), all the flag values in the "image quality priority flag" column are "0" and the flag value of the "start flag" corresponding to job 2 is "1" as shown in FIG. 10(A).

The combined job shown in FIG. 9(B) is an example of a case where all the constituent jobs are with priority on image quality. In this example, as shown in FIG. 9, the appropriate prescribed number of sheets will be exceeded during the printing of job 1 (Yes in step S004) and job 1, which is with priority on image quality, is printed the after appropriate prescribed number of sheets (Yes in step S013). Accordingly, the start timing identifying unit 19*g* identifies job 1 (step S014). Also, as shown in FIG. 9(B), the printing of job 1 is not started after the maximum prescribed number of sheets (No in step S015), and accordingly the start timing identifying unit 19*g* identifies job 1 as the start timing without conducting an identifying process again.

Accordingly, in start timing management table T1 corresponding to the specific example shown in FIG. 9(B), all the flag values in the "image quality priority flag" column are "1" and the flag value of the "start flag" corresponding to job 1 is "1".

The combined job shown in FIG. 9(C) is an example of a case where jobs 1 and 3 are with no priority on image quality and job 2 is with priority on image quality. In this example, as shown in FIG. 9, the appropriate prescribed number of sheets will be exceeded during the printing of job 1 (Yes in step S004) and job 2, which is with priority on image quality, is printed after the appropriate prescribed number of sheets (Yes in step S013). Accordingly, the start timing identifying unit 19*g* identifies job 2 (step S014). Also, as shown in FIG. 9(C), the printing of job 2 is not started after the maximum prescribed number of sheets (No in step S015), and accordingly the start timing identifying unit 19*g* identifies job 2 as the start timing without conducting an identifying process again.

Accordingly, in start timing management table T1 that corresponds to the specific example in FIG. 9(C), only the flag value of the "image quality priority flag" corresponding to job 2 is "1" and the flag value of the "start flag" corresponding to job 2 is "1" as shown in FIG. 10(C).

The combined job shown in FIG. 9(D) is an example of a case where jobs 1 and 2 are with no priority on image quality and job 3 is with priority on image quality. In this example, as shown in FIG. 9, the appropriate prescribed number of sheets will be exceeded during the printing of job 1 (Yes in step S004) and job 3, which is with priority on image quality, is printed after the appropriate prescribed number of sheets (Yes in step S013). Accordingly, the start timing identifying unit 19*g* identifies job 3 (step S014). Also, as shown in FIG. 9(D), the printing of job 3 is started after the maximum prescribed number of sheets (Yes in step S015), and accordingly the start timing identifying unit 19*g* again identifies job 2, which is with no priority on image quality and whose expected cumulative number will reach the maximum prescribed number of sheets (step S017).

Accordingly, in start timing management table T1 that corresponds to the specific example in FIG. 9(D), only the flag value of the "image quality priority flag" of job 3 is "1" and the flag value of the "start flag" corresponding to job 2 is "1" as shown in FIG. 10(D).

Next, by referring to FIG. 11, explanations will be given for identifying of a start timing in a case when a process-target combined job is a job for which the job order can be changed. FIG. 11(A) shows a specific example of a combined job for which the job order can be changed and FIG. 11(B) shows an example of a state of a combined job for which the job order has been changed. Note that the numbers in the parentheses in the figures represent the orders before the order change.

The combined job shown in FIG. 11(A) is an example of a combined job including three constituent jobs, with constituent job 1 with priority on image quality and constituent jobs 2 and 3 with no priority on image quality. When the job order is not changed, the start timing identifying unit 19*g* identifies job 1 because job 1 is a job with priority on image quality and whose expected cumulative number will reach the appropriate prescribed number of sheets during the printing of itself.

Figure 11:
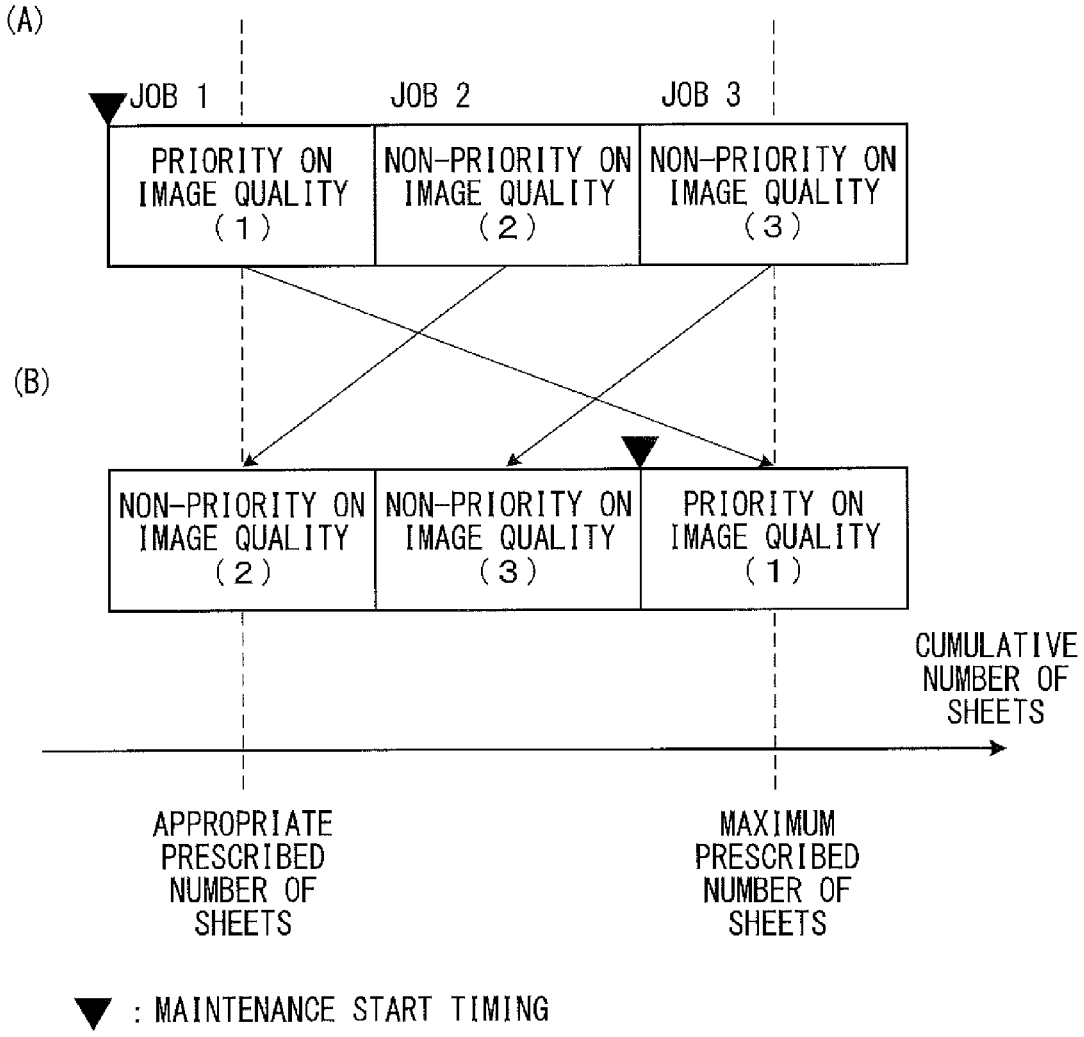
FIG. 11 shows examples of states of a combined job for which the job order can be changed and a combined job after the job order has been changed.

As shown in FIG. 11, the appropriate prescribed number of sheets will be exceeded during the printing of job 2 (Yes in step S004) and the job order can be changed (Yes in step S010) in the present example, and accordingly the job order changing process unit 19*f* changes the order of the constituent jobs (step S011). Accordingly, jobs 2 and 3, which are with no priority on image quality, are moved to positions earlier than job 1 in the present example as shown in FIG. 11. Also, because job 3, which is with priority on image quality, is printed after the appropriate prescribed number of sheets (Yes in step S013), the start timing identifying unit 19*g* identifies job 3 (step S014). Also, the printing of job 3 is not started after the maximum prescribed number of sheets as shown in FIG. 11 (B) (No in step S015), and accordingly the start timing identifying unit 19*g* identifies job 3 as the start timing without conducting an identifying process again.

Although a combined job has been used as an example for the explanation in present embodiment 1, the configuration of present embodiment 1 can also be applied to a job including one job (i.e., an ordinary job). In such a case, when the "image quality setting" of a process-target job is priority on image quality and the expected cumulative number of sheets reaches the appropriate prescribed number of sheets during the printing, the maintenance mechanism control unit 19*j* controls the maintenance mechanism 18 so that the maintenance mechanism 18 executes automatic maintenance before the printing process of the process-target job is started. When the "image quality setting" of a process-target job is no priority on image quality and the cumulative number of sheets does not reach the maximum prescribed number of sheets, the maintenance mechanism control unit 19*j* controls the maintenance mechanism 18 so that the maintenance mechanism 18 conducts automatic maintenance after the termination of the printing process of the process-target job.

According to embodiment 1 described above, when the "image quality setting" of a job whose start timing of automatic maintenance (the timing at which the cumulative number of sheets has reached the appropriate prescribed number of sheets) will arrive during the printing is priority on image quality, the printing device 10 conducts automatic maintenance before the printing process of that job, and when the "image quality setting" of a job whose start timing of automatic maintenance will arrive during the printing is not priority on image quality and the printing process of that job can be conducted before the maximum prescribed number of sheets is reached, the printing device 10 conducts automatic maintenance immediately after the printing process of that job. Thereby, it is possible to change the start timing of automatic maintenance by taking the image quality setting into consideration when the start timing of automatic maintenance arrives during the printing process of a job.

Also, according to embodiment 1 above, the printing device 10 identifies the constituent job with priority on image quality that is to be processed first among constituent jobs with priority on image quality whose printing process will be terminated after the start timing of automatic maintenance (the timing at which the cumulative number of sheets has reached the appropriate prescribed number of sheets). Thereafter, when the printing start timing of the identified constituent job with priority on image quality is after the maximum prescribed number of sheets has been reached, the printing device 10 identifies a constituent job for which a cumulative number of sheets will reach the maximum prescribed number of sheets during the printing and conducts automatic maintenance immediately before the printing process of the identified constituent job. Thereby, it is possible to conduct as many printing processes as possible while taking the image quality setting into consideration before conducting automatic maintenance.

Also, according to embodiment 1 above, when there is not a constituent job with priority on image quality whose printing process will be terminated after the start timing of automatic maintenance (the timing at which the cumulative number of sheets has reached the appropriate prescribed number of sheets), the printing device 10 identifies a constituent job for which a cumulative number of sheets will reach the maximum prescribed number of sheets during the printing and conducts automatic maintenance immediately before the printing process of the identified constituent job. Thereby, it is possible to conduct as many printing process as possible before conducting automatic maintenance. Accordingly, it is possible to minimize the frequency of automatic maintenance, making it possible to minimize the number of times of process interruptions. Also, the reduction in the frequency of automatic maintenance can suppress waste of ink resources.

(Variation Example 1)

In embodiment 1 above, it was described that the process returns to step S001 after the printing process of a combined job in step S006 of the start timing identifying process. However, the scope of the present invention is not limited to this, and it is also possible for example to employ a configuration in which whether or not the cumulative number of sheets has exceeded the appropriate prescribed number of sheets is determined after the process in step S006 as shown in FIG. 12.

Figure 12:
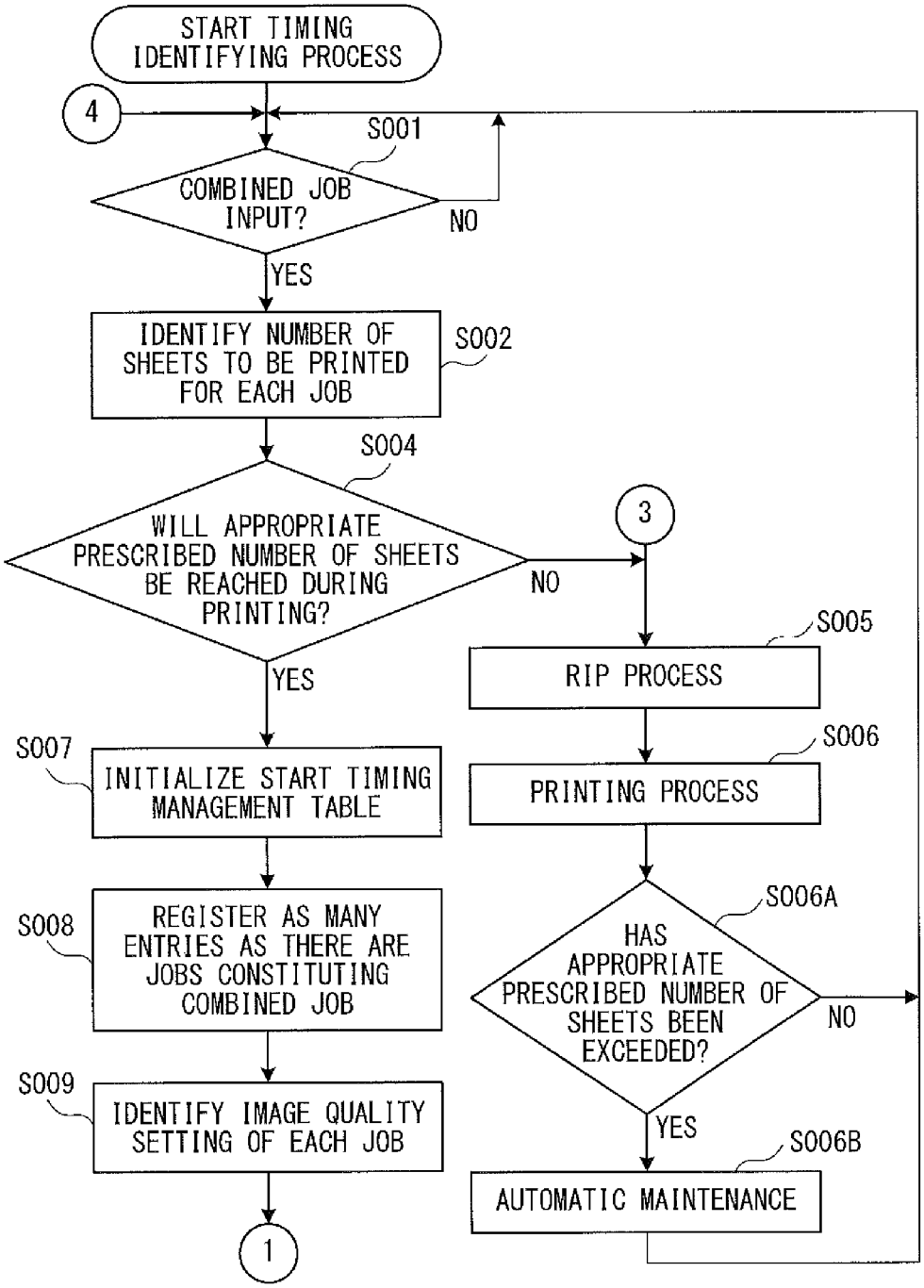
FIG. 12 shows part of an example of a flowchart for explaining a flow of a start timing identifying process according to variation example 1.

FIG. 12 shows part of an example of a flowchart for explaining a flow of a start timing identifying process according to present variation example 1. Hereinafter, explanations will be given for a flow of a start timing identifying process according to present variation example 1 by focusing on points that are different from those in embodiment 1. Note that the process in step S003 in embodiment 1 is omitted in the present variation example 1 as shown in FIG. 12.

The image recording control unit 19*i* controls the image recording unit 17 so that the image recording unit 17 conducts a recording process (printing process) on a print sheet on the basis of generated raster data (step S006). Then, the determination unit 19*a* determines whether or not the cumulative number of sheets has exceeded the appropriate prescribed number of sheets (step S006A).

When it has been determined by the determination unit 19*a* that the appropriate prescribed number of sheets has been exceeded (Yes in step S006A), the maintenance mechanism control unit 19*j* controls the maintenance mechanism 18 so that the maintenance mechanism 18 conducts automatic maintenance (step S006B). Then, the process returns to step S001 and repeats the above process. When it has been determined by the determination unit 19*a* that the appropriate prescribed number of sheets has not been exceeded (No in step S006A), automatic maintenance is not conducted and the process returns to step S001 to repeat the above process.

According to variation example 1 above, all constituent jobs are with no priority on image quality and automatic maintenance is conducted after the printing processes of those constituent jobs when it is possible to finish the printing processes of all the constituent jobs before reaching the maximum prescribed number of sheets. Thereby, in a case when the cumulative number of sheets has exceeded the appropriate prescribed number of sheets at the time when the printing process of the entire combined job has been terminated, automatic maintenance can be conducted before the printing process of the next job. Accordingly, it is possible to suppress the number of times that automatic maintenance causes process interruptions.

(Embodiment 2)

In embodiment 1, a combined job has been used as an example. In present embodiment 2, explanations will be given by using a case when a plurality of copies are printed in one job. A job that prints a plurality of copies can be regarded as a combined job in a broad sense because all the constituent jobs of a job printing a plurality of copies can be regarded as jobs that are identical to each other. In other words, it is possible to apply the configuration of embodiment 1 to a job that can be separated into a plurality of units (referred to as process units hereinafter) in the process of that job. When the configuration of embodiment 1 is applied, it is possible to replace a constituent job with a process unit so as not to conduct a process of changing the job order.

When for example a plurality copies are printed, a copy unit serves as a process unit in a case when the output is made in units of copies. Also, when a plurality of copies are printed, a page unit serves as a process unit in a case when the output is made in units of pages.

Figure 13:
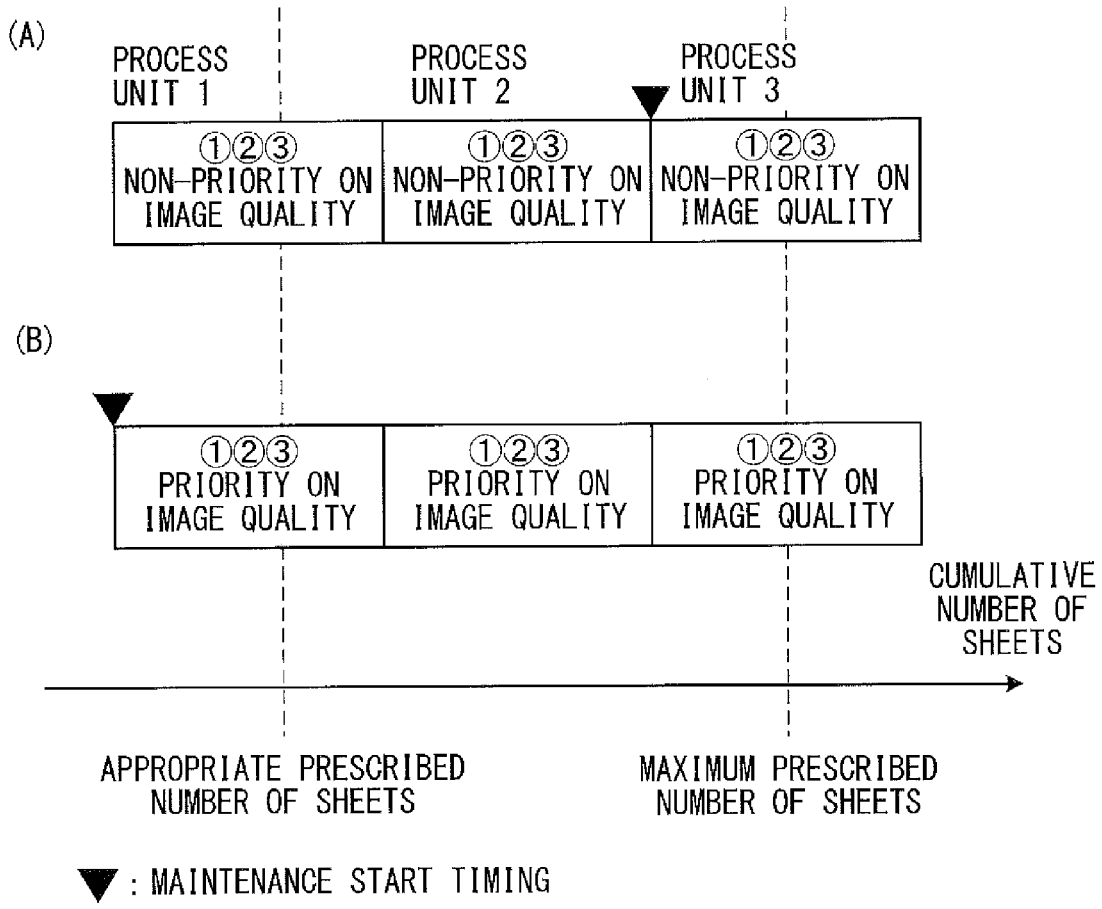
FIG. 13 shows specific examples for explaining a start timing of automatic maintenance in a case when the configuration of embodiment 1 has been applied to process units.

By referring to FIG. 13 and FIG. 14, explanations will be given for identifying of a start timing in a case when the configuration of embodiment 1 has been applied to a process unit. FIG. 13 (A) and FIG. 13 (B) both show specific examples for explaining the start timing of automatic maintenance in a case when the configuration of embodiment 1 has been applied to a process unit. FIG. 14(A) through FIG. 14(D) all show specific examples for explaining the start timing of automatic maintenance in a case when the configuration of embodiment 1 has been applied to different process units.

The job shown in FIG. 13 is an example in a case when a copy unit serves as a process unit and three copies of a printed matter consisting of three pages are printed. The numbers in the figures represent pages, and it is shown that pages that range from page 1 through page 3 are printed for each process unit.

The example shown in FIG. 13(A) is an example of a case when the process-target job is with no priority on image quality. In such a case, as shown in FIG. 13 (A), the appropriate prescribed number of sheets will be exceeded during the printing of process unit 1 (Yes in step S004) and a process unit with priority on image quality is not printed after the appropriate prescribed number of sheets (No in step S013). Also, because the maximum prescribed number of sheets will be exceeded during the printing of process unit 3 (Yes in step S016), the start timing identifying unit 19*g* identifies process unit 3 (step S017).

The example shown in FIG. 13(B) is an example of a case when the process-target job is with priority on image quality. In such a case, as shown in FIG. 13 (B), the appropriate prescribed number of sheets will be exceeded during the printing of process unit 1 (Yes in step S004) and process unit 1, which is with priority on image quality, is printed after the appropriate prescribed number of sheets (Yes in step S013). Accordingly, the start timing identifying unit 19*g* identifies process unit 1 (step S014). Also, because, as shown in FIG. 13(B), printing of process unit 1 is not started after the maximum prescribed number of sheets (No in step S015), the start timing identifying unit 19*g* identifies process unit 1 as process unit 1 as the start timing without conducting an identifying process again.

Figure 14:
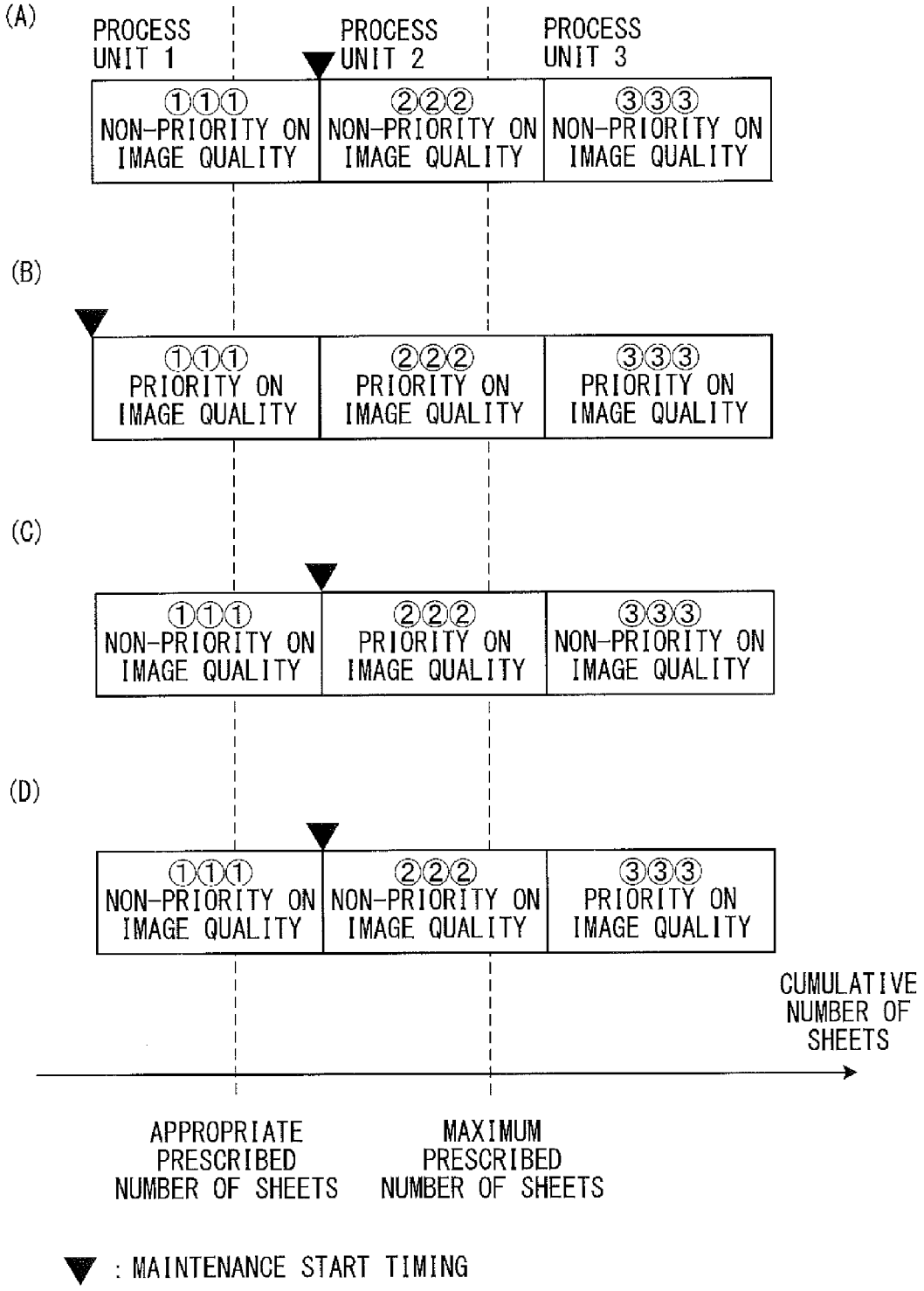
FIG. 14 shows specific examples for explaining a start timing of automatic maintenance in a case when the configuration of embodiment 1 has been applied to process units different from those in FIG. 13.

The example shown in FIG. 14 is an example in a case when a page unit serves as a process unit and three copies of a printed matter consisting of three pages are printed similarly to the example shown in FIG. 13. The specific examples shown in FIG. 14(A) through FIG. 14(D) correspond to FIG. 9(A) through FIG. 9(D), respectively and show identifying of a start timing similarly to a case when a combined job is used as a process target.

Note that it is also possible to employ a configuration in which the "image quality setting" of a process unit in a case when output is made in units of pages is identified on the basis of for example the "image quality setting" of a job and also possible to employ a configuration in which the "image quality setting" is identified for each page on the basis of whether or not an image with a prescribed resolution or higher or an image with a prescribed gray scale or higher is included in an object in the page.

According to embodiment 2 above, the present invention can also be applied to a job that can be separated into process units.

(Embodiment 3)

According to embodiment 1, when the order of constituent jobs can be changed, a constituent job with no priority on image quality is moved to a position earlier than jobs with priority on image quality. This leads to a situation where a job order is changed even when there is no effect that a change in job order reduces the frequency of automatic maintenance. Also, automatically moving a job with no priority on image quality to a position earlier than jobs with priority on image quality may sometimes lead to a situation where the job order change causes an earlier start of automatic maintenance.

Figure 15:
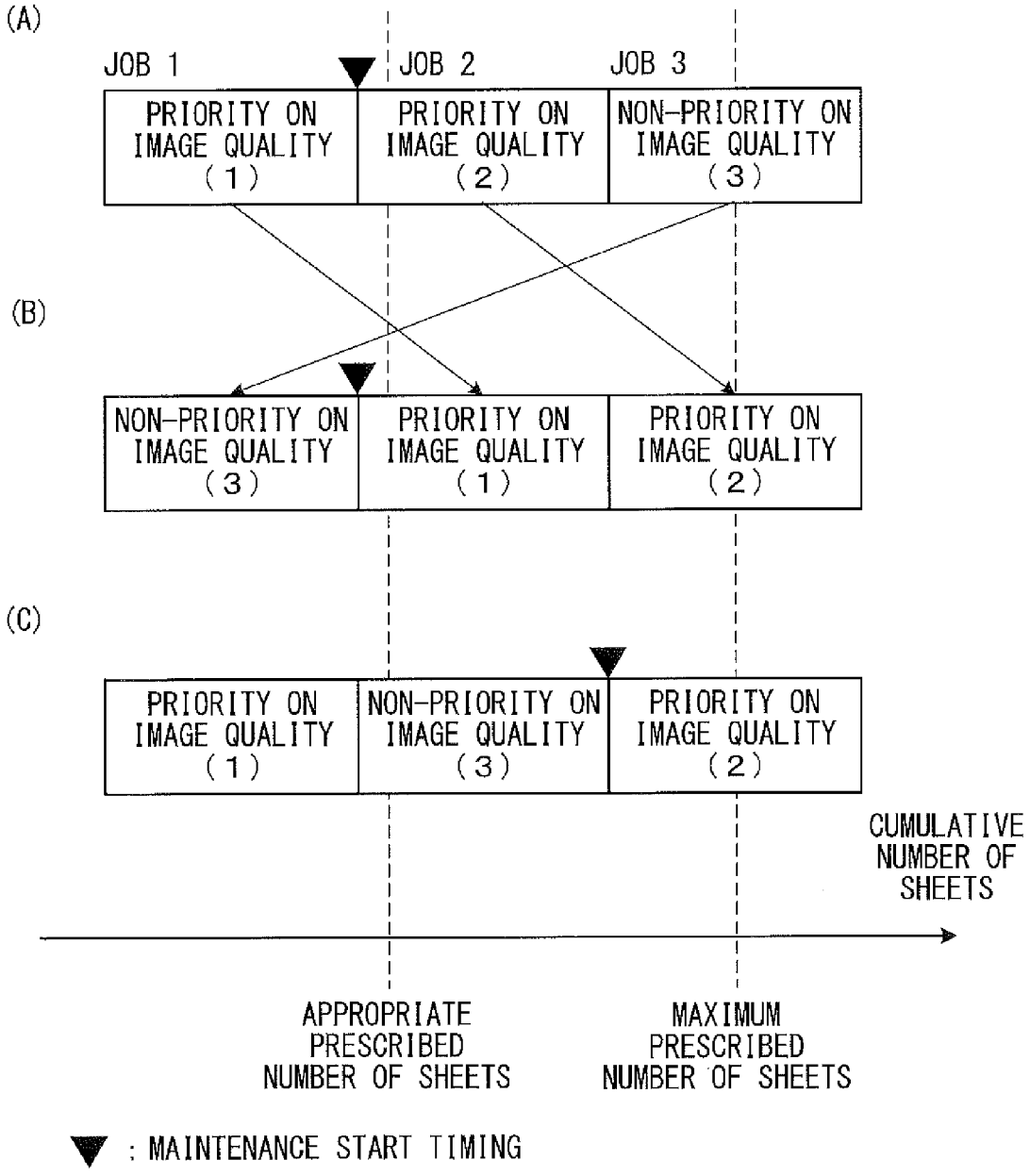
FIG. 15 shows examples of states of a combined job for which the job order can be changed, a combined job after the job order has been changed in a case when the configuration of embodiment 1 has been applied and a different combined job after the job order has been changed.

By using a specific example and referring to FIG. 15, the above problem will be explained further. FIG. 15(A) shows a specific example of a combined job for which the job order can be changed, FIG. 15(B) shows a state of the constituent jobs after a job order change in a case when the configuration of embodiment 1 has been applied and FIG. 15(C) shows an example of a state of the constituent jobs after a job order change that is different from the change in FIG. 15(B). The numbers in parentheses in the figures represent the orders before the changes. In this example, a combined job for which the job order can be changed is a combined job having the checkbox for "possible to change job order" checked as described above.

The combined job shown in FIG. 15(A) is an example of a combined job including three constituent jobs, with jobs 1 and 2 with priority on image quality and job 3 with no priority on image quality. When the job order is not changed, the start timing identifying unit 19*g* identifies job 2, which is with priority on image quality and whose expected cumulative number of sheets will reach the appropriate prescribed number of sheets during the printing as shown in FIG. 15(A).

FIG. 15(B) shows a constituent job after a job order change in accordance with the method explained in embodiment 1. In such a case, the start timing identifying unit 19*g* identifies job 2, which is with priority on image quality and whose expected cumulative number of sheets will reach the appropriate prescribed number of sheets during the printing as shown in FIG. 15(B). Accordingly, when jobs 1 and 3 have an identical number of the sheets to be printed before a job order change, the effect of reducing the frequency of automatic maintenance is not practically obtained even when the job order is changed.

FIG. 15(C) shows a state of a combined job in a case when job 3, which is with no priority on image quality, has been moved to the position between jobs 1 and 2, which are with priority on image quality, without using the method explained in embodiment 1. In such a case, the printing process of job 1, which is the first job and is with priority on image quality, can be finished before the appropriate prescribed number of sheets and the printing process of job 2, which is the next job and is with no priority on image quality, can be finished before the maximum prescribed number of sheets, and accordingly the start timing identifying unit 19*g* identifies job 3, which is the third job and is with priority on image quality as shown in FIG. 15(C). In other words, this case brings about higher effects of reducing the frequency of automatic maintenance.

Accordingly, present embodiment 3 optimizes job order changes in order to maximize the effect of reducing the frequency of automatic maintenance caused by job order changes.

The fundamental configuration of the printing device 10 according to present embodiment 3 is similar to that of embodiment 1. However, the job order changing process unit 19*f* in the present embodiment 3 has functions slightly different from those of the job order changing process unit 19*f* in embodiment 1.

The job order changing process unit 19*f* according to present embodiment 3 optimizes a job order change when the job order of constituent jobs constituting a process-target combined job can be changed. More specifically, when there is a job with priority on image quality among constituent jobs constituting a combined job, the job order changing process unit 19*f* identifies a constituent job with priority on image quality that can be printed before the appropriate prescribed number of sheets is reached if the printing of that job is started earlier than other jobs. When for example there is a combined job including jobs 1 through 6 and jobs 1, 3 and 6 are constituent jobs with priority on image quality and jobs 1 and 3 can be printed before the appropriate prescribed number of sheets is reached, the job order changing process unit 19*f* identifies jobs 1 and 3.

When such a job with priority on image quality has been able to be identified, the job order changing process unit 19*f* moves the identified constituent job to an earlier position. When for example jobs 1 and 3 have been identified, the combined job after the moving is a combined job (1, 3, 2, 4, 5, 6).

Thereafter, when there is not a job with no priority on image quality, the job order changing process unit 19*f* terminates the change of the job order at that moment. When there is a job with no priority on image quality, the job order changing process unit 19*f* identifies, from among constituent jobs with no priority on image quality, a job that can be printed before the maximum prescribed number of sheets is reached if the printing of that job is started immediately after the moved constituent job with priority on image quality.

When such a job with no priority on image quality has not been able to be identified, the job order changing process unit 19*f* terminates the change of the order of the constituent jobs at that moment. When such a job with no priority on image quality has been able to be identified and the identified constituent jobs with no priority on image quality account for all the constituent jobs other than the constituent jobs with priority on image quality that were identified previously, the job order changing process unit 19*f* terminates the change of the order of the constituent jobs at that moment because it is not necessary to move the identified constituent job with no priority on image quality.

When such a constituent job with no priority on image quality has been able to be identified and the identified constituent jobs with no priority on image quality do not account for all the constituent jobs other than the constituent jobs with priority on image quality that were identified previously, the job order changing process unit 19*f* moves the identified constituent jobs with no priority on image quality to positions immediately later than the constituent jobs with priority on image quality that were moved previously.

When it has not been possible to identify a constituent job with priority on image quality that can be printed before the appropriate prescribed number of sheets is reached if the printing of that job is started earlier than other jobs and there is not a constituent job with no priority on image quality, the job order changing process unit 19*f* terminates the process without changing the job order.

When it has not been possible to identify a constituent job with priority on image quality that can be printed before the appropriate prescribed number of sheets is reached if the printing of that job is started earlier than other jobs and there is a constituent job with no priority on image quality, the job order changing process unit 19*f* identifies, from among constituent jobs with no priority on image quality, a constituent job that can be printed before the maximum prescribed number of sheets is reached if the printing of that job is started earlier than other jobs. When for example jobs 2, 4 and 5 can be printed before the maximum prescribed number of sheets is reached among jobs 2, 4 and 5, which are constituent jobs with no priority on image quality, the job order changing process unit 19*f* identifies jobs 2, 4 and 5.

When such a constituent job with no priority on image quality has not been able to be identified, the job order changing process unit 19*f* terminates the process without changing the job order. When such a constituent job with no priority on image quality has been able to be identified, the job order changing process unit 19*f* moves the identified constituent job with no priority on image quality to an earlier position because the identified constituent jobs with no priority on image quality do not account for all the constituent jobs constituting the process-target combined job.

When all the constituent jobs constituting a process-target combined job are with no priority on image quality, the job order changing process unit 19*f* identifies, from among the constituent jobs with no priority on image quality, a constituent job that can be printed before the maximum prescribed number of sheets is reached if the printing of that constituent job is started earlier than other constituent jobs.

When such a constituent job with no priority on image quality has not been able to be identified, the job order changing process unit 19*f* terminates the process without changing the job order. Even when such a constituent job with no priority on image quality has been able to be identified, if the identified constituent jobs with no priority on image quality account for all the constituent jobs constituting the process-target combined job, the job order changing process unit 19*f* terminates the process without changing the job order because it is not necessary to change the job order.

When such a constituent job with no priority on image quality has been able to be identified and the identified constituent jobs with no priority on image quality do not account for all the constituent jobs constituting the process-target combined job, the job order changing process unit 19*f* moves the identified constituent jobs with no priority on image quality to earlier positions.

Figure 16:
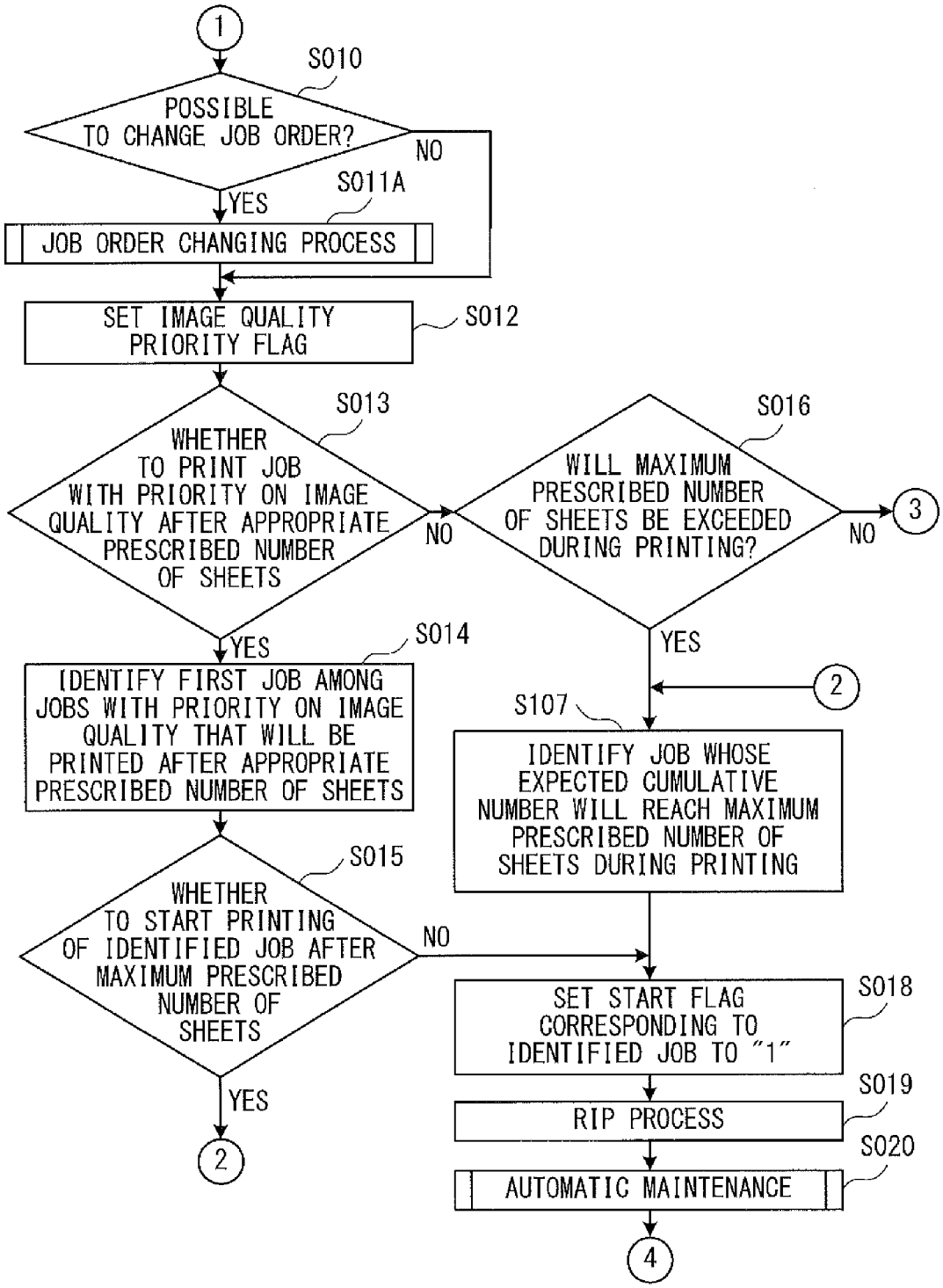
FIG. 16 shows part of an example of a flowchart for explaining a flow of a start timing identifying process according to embodiment 3.

Next, by referring to FIG. 16, explanations will be given for a flow of a start timing identifying process according to present embodiment 3. FIG. 16 shows part of an example of a flowchart for the explanations for a flow of the start timing identifying process according to present embodiment 3. This start timing identifying process is triggered by input of a combined job. Note that like processes as in embodiment 1 are denoted by like numerals, and explanations will be given focusing on different points.

After the process in step S009, the process proceeds to step S010, and the determination unit 19*a* determines whether or not the order of the constituent jobs can be changed (step S010). When it has been determined by the determination unit 19*a* that the order of the constituent jobs cannot be changed (No in step S010), the process proceeds to step S012, which was explained in embodiment 1.

When it has been determined by the determination unit 19*a* that the order of the constituent jobs can be changed (Yes in step S010), the job order changing process unit 19*f* conducts a job order changing process (step S011A). Thereafter, the process proceeds to step S012, which was explained in embodiment 1.

Figure 17:
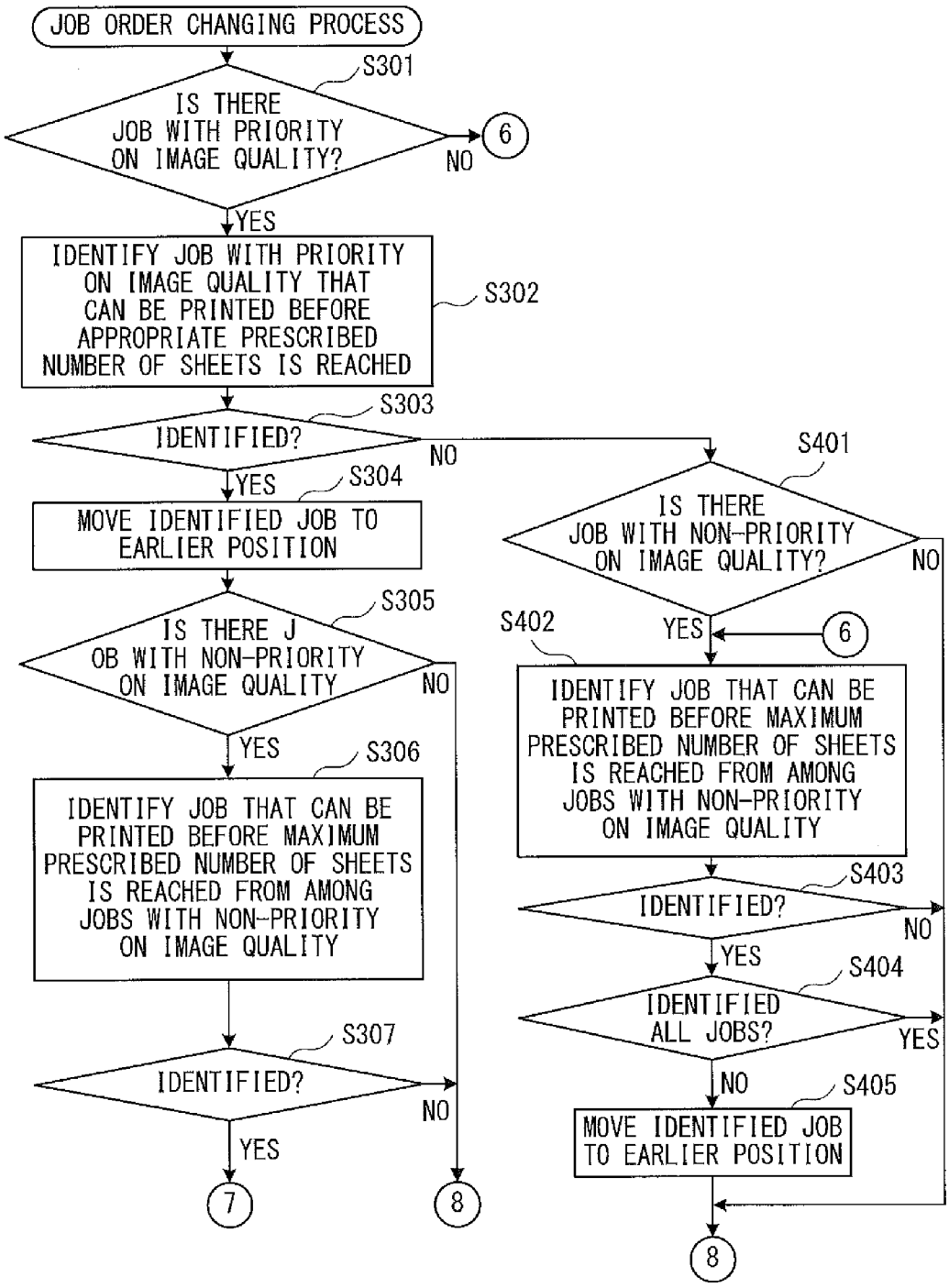
FIG. 17 shows part of an example of a flowchart for explaining a flow of a job order changing process according to embodiment 3.
Figure 18:
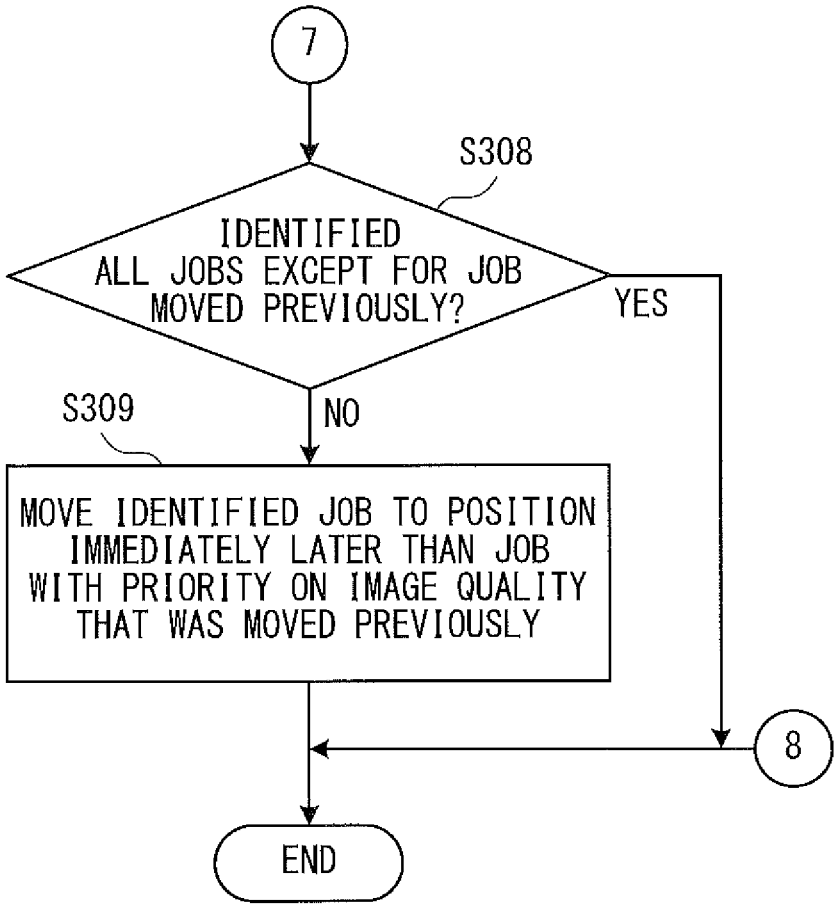
FIG. 18 shows the rest of the example of the flowchart for explaining the flow of the job order changing process according to embodiment 3.

Next, by referring to FIG. 17 and FIG. 18, explanations will be given for a flow of the job order changing process according to present embodiment 3. FIG. 17 shows part of an example of a flowchart for the explanations for a flow of the job order changing process according to present embodiment 3 and FIG. 18 shows the rest of it. This job order changing process is a process corresponding to the process in step S011A of the start timing identifying process according to present embodiment 3.

The job order changing process unit 19*f* determines whether or not there is a constituent job with priority on image quality among constituent jobs constituting the combined job (step S301). When it has been determined by the job order changing process unit 19*f* that there is not a constituent job with priority on image quality (No in step S301), the process proceeds to step S402, which will be described later.

When it has been determined that there is a constituent job with priority on image quality (Yes in step S301), the job order changing process unit 19*f* identifies a constituent job with priority on image quality that can be printed before the appropriate prescribed number of sheets is reached if the printing of that constituent job is started earlier than other constituent jobs (step S302). Then, the job order changing process unit 19*f* determines whether or not it has been possible to identify a constituent job with priority on image quality that can be printed before the appropriate prescribed number of sheets is reached if the printing of that constituent job is started earlier than other constituent jobs (step S303).

When it has been determined by the job order changing process unit 19*f* that such a constituent job with priority on image quality has not been able to be identified (No in step S303), the process proceeds to step S401, which will be described later. When it has been determined that such a constituent job with priority on image quality has been able to be identified (Yes in step S303). The job order changing process unit 19*f* moves the identified constituent job with priority on image quality to an earlier position (step S304).

Then, the job order changing process unit 19*f* determines whether or not there is a constituent job with no priority on image quality is among constituent jobs that constitute the combined job (step S305).

When it has been determined that there is not a constituent job with no priority on image quality (No in step S305), the job order changing process unit 19*f* terminates the change of the order of the constituent jobs at that moment, and the process proceeds to step S012 of the start timing identifying process. When it has been determined that there is a constituent job with no priority on image quality (Yes in step S305), the job order changing process unit 19*f* identifies, from among constituent jobs with no priority on image quality, a constituent job that can be printed before the maximum prescribed number of sheets is reached if the printing of that constituent job is started immediately after the moved constituent job with priority on image quality (step S306).

Then, job order changing process unit 19*f* determines whether or not a constituent job with no priority on image quality that can be printed before the maximum prescribed number of sheets is reached (step S307). When it has been determined that a constituent job with no priority on image quality that can be printed before the maximum prescribed number of sheets is reached was not be able to be identified (No in step S307), the job order changing process unit 19*f* terminates the change of the order of the constituent jobs at that moment, and the process proceeds to step S012 of the start timing identifying process.

When it has been determined that a constituent job with no priority on image quality that can be printed before the maximum prescribed number of sheets is reached was able to be identified (Yes in step S307), the job order changing process unit 19*f* further determines whether or not the identified constituent jobs with no priority on image quality account for all the constituent jobs other than the constituent jobs of the constituent job with priority on image quality that were moved previously (step S308).

When it has been determined that the identified constituent jobs with no priority on image quality account for all the constituent jobs other than the constituent jobs with priority on image quality that were moved previously (Yes in step S308), job order changing process unit 19*f* terminates the change of the order of the constituent jobs at that moment, and the process proceeds to step S012 of the start timing identifying process. When it has been determined that the identified constituent jobs with no priority on image quality do not account for all the constituent jobs with priority on image quality that were moved previously (No in step S308), the job order changing process unit 19*f* moves the identified constituent jobs with no priority on image quality to the position immediately later than the constituent job with priority on image quality that was moved previously (step S309). Then, the job order changing process unit 19*f* terminates the change of the order of the constituent jobs at that moment, and the process proceeds to step S012 of the start timing identifying process.

When it has been determined that a constituent job with priority on image quality was not able to be identified in the process of step S303 (Yes in step S303), the job order changing process unit 19*f* further determines whether or not there is a constituent job with no priority on image quality among constituent jobs constituting the combined job (step S401). When it has been determined that there is not a constituent job with no priority on image quality (No in step S401), the job order changing process unit 19*f* terminates the present process without changing the order of the constituent jobs. Then, the process proceeds to step S012 of the start timing identifying process.

When it has been determined that there is not a constituent job with no priority on image quality (Yes in step S401), the job order changing process unit 19*f* identifies a constituent job that can be printed before the maximum prescribed number of sheets is reached if the printing of that job is started earlier than other jobs (step S402). Then, the job order changing process unit 19*f* determines whether or not a constituent job with no priority on image quality that can be printed before the maximum prescribed number of sheets is reached was able to be identified (step S403).

When it has been determined that a constituent job with no priority on image quality that can be printed before the maximum prescribed number of sheets is reached was not able to be identified (No in step S403), the job order changing process unit 19*f* terminates the present process without changing the order of the constituent jobs. Then, the process proceeds to step S012 of the start timing identifying process.

When it has been determined that a constituent job with no priority on image quality that can be printed before the maximum prescribed number of sheets is reached was able to be identified (Yes in step S403), the job order changing process unit 19*f* further determines whether or not the identified constituent jobs with no priority on image quality account for all the constituent jobs (step S404). When it has been determined that the identified constituent jobs with no priority on image quality account for all the constituent jobs (Yes in step S404), the job order changing process unit 19*f* terminates the present process without changing the order of the constituent jobs. Then, the process proceeds to step S012 of the start timing identifying process.

When it has been determined that the identified constituent jobs with no priority on image quality do not account for all the constituent jobs (No in step S404), the job order changing process unit 19*f* moves the identified constituent jobs with no priority on image quality to earlier positions (step S405). Then, the present process is terminated and the process proceeds step S012 of the start timing identifying process.

Next, by referring to FIG. 19 and by using a specific example, explanations will be given for changing of the order of constituent jobs and identifying of a start timing according to present embodiment 3. FIG. 19(A) shows a specific example of a combined job in which the job order can be changed and FIGS. 19(B) and 19(C) respectively show examples of states of combined jobs at different points in time in a case when the configuration of the present embodiment 3 has been applied. Note that the numbers in the parentheses in the figures represent the orders before the order change.

Figure 19:
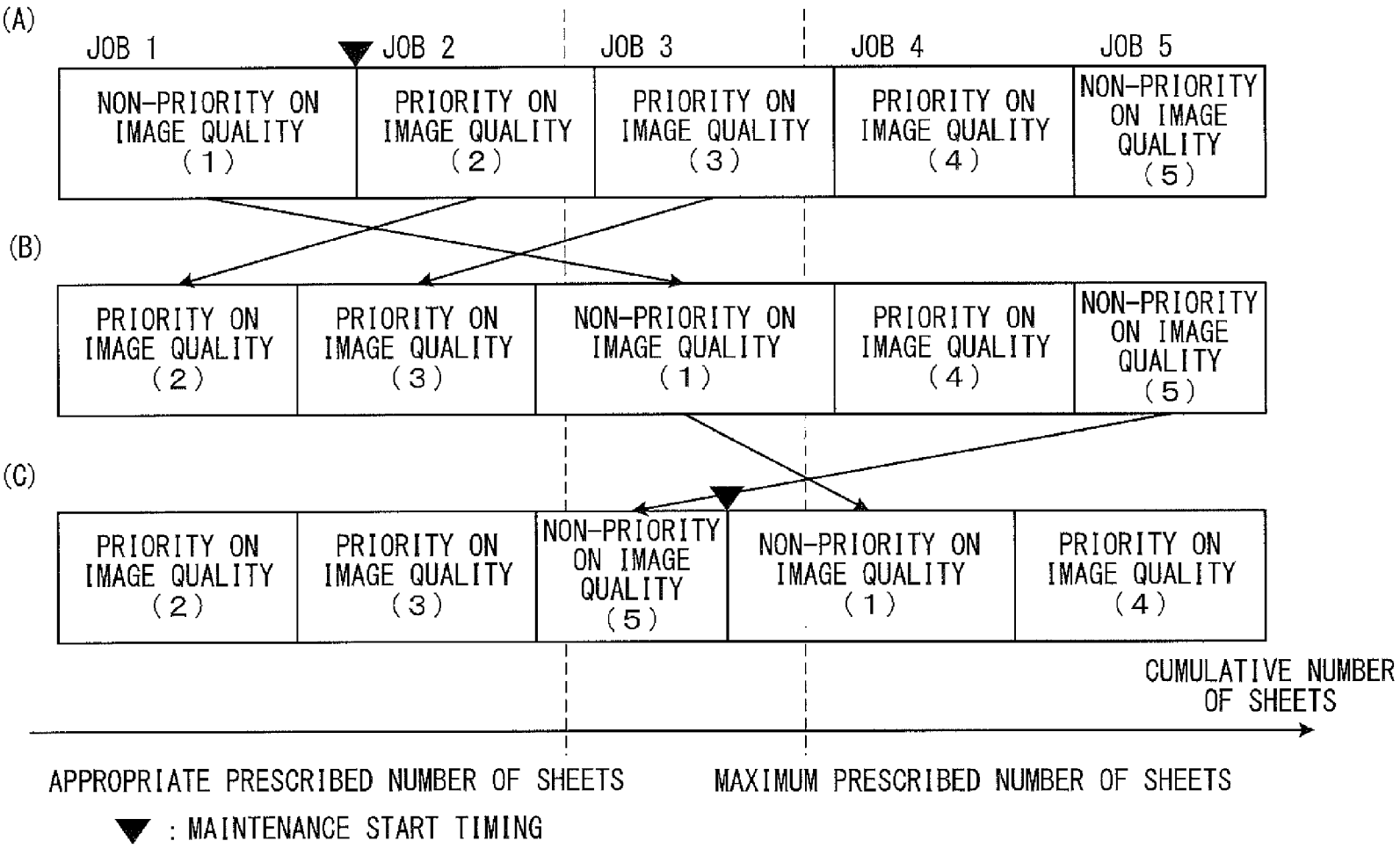
FIG. 19 shows examples of states of a combined job for which the job order can be changed and combined jobs at different points in time in a case when the configuration of embodiment 3 has been applied.

The combined job shown in FIG. 19(A) is a combined job including five constituent jobs and is an example of a combined job with jobs 2 through 4 with priority on image quality and jobs 1 and 5 with no priority on image quality. Note that FIG. 19 (A) shows a state of the combined job before the job order is changed. When the job order is not changed, the start timing identifying unit 19*g* identifies job 2 because job 1 is with no priority on image quality and the appropriate prescribed number of sheets will be reached during the printing of job 2, which is with priority on image quality as shown in FIG. 19 (A).

Next, explanations will be a case where the job order changing process according to present embodiment 3 has been applied to the combined job shown in FIG. 19(A).

First, because there are constituent jobs with priority on image quality (Yes in step S301), the job order changing process unit 19*f* identifies jobs 2 and 3, which are constituent jobs with priority on image quality and can be printed before the appropriate prescribed number of sheets is reached if the printing of them is started earlier than other constituent jobs (step S302 and YES in step S303). Then, the job order changing process unit 19*f* moves identified jobs 2 and 3 to positions earlier than job 1 (step S304). FIG. 19(B) shows a state of a combined job after jobs 2 and 3 have been moved to positions earlier than job 1.

Then, because there are constituent jobs with no priority on image quality (Yes in step S305), the job order changing process unit 19*f* identifies job 5, which is a constituent job with no priority on image quality and can be printed before the maximum prescribed number of sheets is reached if the printing of that constituent job is started immediately after moved jobs 2 and 3 (step S306 and Yes in step S307). In this example, because there are constituent jobs that remain unidentified such as job 1 etc. (No in step S308), the job order changing process unit 19*f* moves identified job 5 to the position immediately later than jobs 2 and 3 (step S309). FIG. 19(C) shows a state of the combined job after job 5 was moved to the position immediately later than jobs 2 and 3.

According to embodiment 3 above, the printing device 10 changes the order of constituent jobs constituting the combined job so that as many sheets as possible can receive printing processes before automatic maintenance is started. This makes it possible to minimize the frequency of automatic maintenance and to minimize the number of times of process interruptions. Also, the reduction in the frequency of automatic maintenance can suppress waste of ink resources.

Also, according to embodiment 3 above, the printing device 10 identifies a constituent job with priority on image quality that can be printed before the appropriate prescribed number of sheets is reached if the printing of that constituent job is started earlier than other constituent jobs and moves the identified constituent job with priority on image quality to an earlier position. Thereby, even when automatic maintenance is started immediately after the printing process of the constituent job with priority on image quality that has been moved to an earlier position, it is possible to guarantee the image quality because the constituent job with priority on image quality that has been moved to an earlier position receives the printing process before the appropriate prescribed number of sheets is reached.

Also, according to embodiment 3 above, the printing device 10 identifies a constituent job with no priority on image quality that can be printed before the maximum prescribed number of sheets is reached if the printing of that constituent job is started immediately after the constituent job with priority on image quality that was moved to an earlier position and moves that identified constituent job to the position immediately later than the constituent job with priority on image quality that was moved to an early position. Thereby, it is possible to conduct as many printing processes as possible before automatic maintenance is started. This makes it possible to minimize the frequency of automatic maintenance and to minimize the number of times of process interruptions. Also, the reduction in the frequency of automatic maintenance can suppress waste of ink resources.

It is also possible to employ a configuration in which an operation program for executing the above operations are stored in a computer-readable recording medium such as a flexible disk, a CD-ROM (Compact Disk-Read Only Memory), a DVD (Digital Versatile Disk) an MO (Magneto Optical disk), etc. to distribute the medium so that the operation program is installed on a computer of the printing device 10 and the above process are executed. Further, it is also possible to employ a configuration in which the program is stored in a disk device etc. included in a server device in the Internet in advance so that the program is for example superimposed on carrier waves and a computer obtains it by downloading it or in other forms According to the image recording device described above, when the "image quality setting" is priority on image quality for a job for which a cumulative number of sheets will reach, during the printing process, the lower limit of the cumulative number of sheets representing the earliest start timing of maintenance (appropriate prescribed number of sheets), the maintenance is conducted before the printing process of that job. Thereby, it is possible to change the start timing of maintenance by taking the image quality setting into consideration when a start timing of maintenance arrives during the printing process of a job.

Also, when the "image quality setting" is no priority on image quality for a job for which a cumulative number of sheets will reach, during the printing process, the lower limit (appropriate prescribed number of sheets) and it is possible to conduct the printing process of that job before the upper limit of cumulative number of sheets (maximum prescribed number of sheets) representing the latest start timing of maintenance is reached, maintenance is conducted after the printing process of that job. Thereby, it is possible to start maintenance by taking image quality setting into consideration when the start timing of maintenance arrives during the printing process of that job.

Also, when the "image quality setting" is priority on image quality for a constituent job (or a process unit) for which a cumulative number of sheets will reach the lower limit (appropriate prescribed number of sheets) during the printing process, maintenance is conducted before the printing process of that constituent job (or that process unit), whereas the "image quality setting" is no priority on image quality for a constituent job (or a process unit) for which a cumulative number of sheets will reach the lower limit (appropriate prescribed number of sheets) during the printing process and it is possible to conduct the printing process of that constituent job (or that process unit) before the upper limit (maximum prescribed number of sheets) is reached, maintenance is conducted after the printing process of that constituent job (or that process unit). Thereby, it is possible to change the start timing of maintenance by taking the image quality setting into consideration so that the start timing corresponds to separating points of constituent jobs (or process units) when the start timing of maintenance arrives during the printing process of a constituent job (or a process unit).

Also, the constituent job (or the process unit) with priority on image quality that is processed first among constituent jobs (or process units) with priority on image quality for which the printing processes will be terminated after the cumulative numbers of sheets have reached the lower limit (appropriate prescribed number of sheets) is identified. Thereafter, when the printing of the identified constituent job (or the process unit) with priority on image quality is started before the upper limit (appropriate prescribed number of sheets) is reached, maintenance is conducted immediately before the printing process of the identified constituent job (or the process unit) with priority on image quality. When the printing of the identified constituent job (or the process unit) with priority on image quality is started after the upper limit (maximum prescribed number of sheets) has been reached, a constituent job (or a process unit) for which a cumulative number of sheets will reach the upper limit (maximum prescribed number of sheets) during the printing process is identified and maintenance is conducted immediately before the printing process of the identified constituent job (or the process unit). Thereby, it is possible to conduct as many printing processes as possible before conducting maintenance while taking image quality setting into consideration.

Also, the order of the printing processes of constituent jobs constituting a combined job is changed so that as many sheets as possible can receive printing processes before maintenance is started. Thereby, it is possible to minimize the frequency of maintenance and also to minimize the number of times of process interruptions. Also, the reduction in the frequency of maintenance can suppress waste of ink resources.

In addition, the present invention is not limited to the above-described embodiments as they are, but may be embodied by deforming constituents within a scope not deviating from the gist of the invention. In addition, various inventions can be made by appropriately combining a plurality of constituents that have been disclosed in the above embodiments. For example, all the constituents that have been disclosed in the embodiments may be appropriately combined. Further, constituents in different embodiments may be appropriately combined. It should be understood that various modifications and applications can be made without departing from the scope and the spirit of the invention.

What is claimed is:

1. An image recording device comprising:

a maintenance mechanism that conducts, according to a print job, maintenance for maintaining and recovering an ink ejection function of a recording head that conducts a printing process on a print medium; and a maintenance mechanism control unit that defines, as a cumulative number, a number of print media on which the printing process has been conducted after previous maintenance was conducted, that presets a lower limit and an upper limit of the cumulative number for determining whether or not to conduct the maintenance, and that makes the maintenance mechanism conduct the maintenance in accordance with a result of comparing the cumulative number estimated for the printing process based on the print job with the lower limit and the upper limit, wherein the maintenance mechanism control unit makes the maintenance mechanism conduct the maintenance before start of printing of the print job when priority on image quality, which requires high quality printing, is set in the print job, when the cumulative number is less than the lower limit before the print job starts, and when the cumulative number is estimated to reach the lower limit during the printing process.

2. The image recording device according to claim 1, wherein the maintenance mechanism control unit makes the maintenance mechanism conduct the maintenance after termination of printing based on the print job when the priority on image quality is not set in the print job, when the cumulative number is less than the lower limit before the print job starts, and when the cumulative number is estimated to reach the lower limit during the printing process and become less than the upper limit after the print job is finished.

3. The image recording device according to claim 2, further comprising a job identifying unit that, when a plurality of said print jobs are combined, identifies a print job for determining the starting of conducting the maintenance from among the plurality of combined print jobs, wherein, when the job identifying unit identifies a first print job from among the plurality of combined print jobs, the first print job being a print job such that the priority on image quality is set and such that the cumulative number is estimated to reach the lower limit during the printing process, the maintenance mechanism control unit makes the maintenance mechanism conduct the maintenance before printing based on the first print job starts, and wherein, when the job identifying unit identifies a second print job from among the plurality of combined print jobs, the second print job being a print job such that the priority on image quality is not set, such that the cumulative number is less than the lower limit before printing starts, and such that the cumulative number is estimated to reach the lower limit during the printing process and become lower than the upper limit during the printing process, the maintenance mechanism control unit makes the maintenance mechanism conduct the maintenance after printing based on the second job is finished.

4. The image recording device according to claim 3, further comprising a changing unit that changes an original print order in which the plurality of combined print jobs are printed, wherein the changing unit changes the print order such that a third print job is initially printed when the job identifying unit identifies the third print job from among the plurality of combined print jobs, the third print job being a print job such that the priority on image quality is set, such that the cumulative number will reach the lower limit during the printing process if printing is conducted in the original print order, and such that printing is estimated to be finished before the cumulative number reaches the lower limit if the third print job is initially printed, wherein the maintenance mechanism conducts the maintenance based on the changed print order in which the plurality of combined print jobs are printed.

5. The image recording device according to claim 4, wherein the changing unit changes the print order such that a fourth print job is printed immediately after the third print job is printed when the job identifying unit identifies the fourth print job from among the plurality of combined print jobs, the fourth print job being a print job such that the priority on image quality is not set and such that printing is estimated to be finished before the cumulative number reaches the upper limit if the fourth print job is printed immediately after the third print job is printed.

6. The image recording device according to claim 3, wherein the plurality of combined print jobs are as many print jobs as a number of sheets to be printed out, and share a same print content.

7. The image recording device according to claim 3, wherein the plurality of combined print jobs are print jobs for printing out a plurality of sheets on which a same page is printed.

* * * * *